US011719257B2

(12) United States Patent
Winkler

(10) Patent No.: US 11,719,257 B2
(45) Date of Patent: Aug. 8, 2023

(54) THIN LAYERED HEATING ELEMENT FOR A FLUID PUMP

(71) Applicant: Sanhua Aweco Appliance Systems GmbH, Neukirch (DE)

(72) Inventor: Jürgen Winkler, Seeham (AT)

(73) Assignee: Sanhua Aweco Appliance Systems GmbH, Neukirich (DE)

( * ) Notice: Subject to any disclaimer, the term of this patent is extended or adjusted under 35 U.S.C. 154(b) by 364 days.

(21) Appl. No.: 16/108,649

(22) Filed: Aug. 22, 2018

(65) Prior Publication Data

US 2019/0063462 A1 Feb. 28, 2019

(30) Foreign Application Priority Data

Aug. 25, 2017 (EP) ..... 17188041

(51) Int. Cl.
*F04D 29/58* (2006.01)
*F04D 29/02* (2006.01)
(Continued)

(52) U.S. Cl.
CPC ..... *F04D 29/586* (2013.01); *A47L 15/4285* (2013.01); *F04D 29/026* (2013.01); *F04D 29/426* (2013.01); *F04D 29/4293* (2013.01); *F04D 29/588* (2013.01); *H05B 3/42* (2013.01); *F05D 2300/2102* (2013.01);
(Continued)

(58) Field of Classification Search
CPC .. F04D 29/586; F04D 29/4293; F04D 29/588; F04D 29/426; F04D 29/026; H05B 3/42; H05B 2203/013; H05B 2203/022; H05B 2203/021; H05B 1/02; H05B 1/0244; H05B 1/0291; H05B 3/26; H05B 3/22;
(Continued)

(56) References Cited

U.S. PATENT DOCUMENTS 2,119,680 A * 6/1938 Long ..... H05B 3/20 219/537
2,491,266 A * 12/1949 Hooper ..... F24H 9/1818 392/459
(Continued)

FOREIGN PATENT DOCUMENTS

CN 1883229 A 12/2006
CN 101429937 A 5/2009
(Continued)

OTHER PUBLICATIONS

Raw machine translation of EP2478816 (A2),"Dishwasher with at least one heating element for heating the rinsing liquid", Lutz et al.,Jul. 25, 2012.*

*Primary Examiner* — Devon C Kramer
*Assistant Examiner* — Lilya Pekarskaya
(74) *Attorney, Agent, or Firm* — Seed Intellectual Property Law Group LLP

(57) ABSTRACT

A heating element and fluid pump including that heating element. The heating element for a fluid pump comprises a substrate, preferably made of glass, in particular quartz glass, or ceramics, a thin layer of monocrystalline, polycrystalline or amorphous material provided on top of the substrate, and electrical contacts provided in contact with the thin layer, preferably made of conductive ink or an electrically-conductive paste, wherein the thin layer has a thickness equal to or smaller than 10 μm.

14 Claims, 23 Drawing Sheets

(51) Int. Cl.
*F04D 29/42* (2006.01)
*H05B 3/42* (2006.01)
*A47L 15/42* (2006.01)

(52) U.S. Cl.
CPC ..... *F05D 2300/2106* (2013.01); *H05B 2203/013* (2013.01); *H05B 2203/021* (2013.01); *H05B 2203/022* (2013.01)

(58) Field of Classification Search
CPC ..... A47L 15/4285; F05D 2300/2102; F05D 2300/2106
USPC ..... 219/535, 503, 541
See application file for complete search history.

(56) References Cited

U.S. PATENT DOCUMENTS 4,889,974 A * 12/1989 Auding ..... H01C 7/021 219/543
5,573,692 A * 11/1996 Das ..... A24F 40/46 219/543
8,245,718 B2 8/2012 Büsing et al.
9,493,906 B2 * 11/2016 Werkman ..... D06F 75/24
9,714,664 B2 * 7/2017 Ishikawa ..... F04D 29/023
10,260,505 B2 * 4/2019 Block ..... F04D 29/586
10,302,098 B2 * 5/2019 Li ..... F04D 29/588
2002/0027130 A1 * 3/2002 Miyata ..... H05B 3/148 219/444.1
2007/0059179 A1 * 3/2007 Xu ..... F04D 29/162 416/182
2010/0126534 A1 * 5/2010 Busing ..... F04D 29/026 415/177
2012/0263581 A1 * 10/2012 Li ..... F04D 29/588 415/177
2013/0022455 A1 * 1/2013 Weber ..... F04D 29/445 415/206
2013/0108252 A1 * 5/2013 Liu ..... F04D 29/426 392/471
2015/0044073 A1 * 2/2015 Badafem ..... F04D 13/06 417/313
2015/0086325 A1 * 3/2015 Koebrich ..... F04D 19/00 415/1
2016/0169230 A1 * 6/2016 Block ..... F04D 1/00 415/203

FOREIGN PATENT DOCUMENTS

CN 102979736 A 3/2013
CN 103890408 A 6/2014
CN 104348287 A 2/2015
CN 105317693 A 2/2016
DE 102014224593 A1 6/2016
EP 2377451 A1 10/2011
EP 2478816 A2 7/2012
WO 2005051042 A1 6/2005

* cited by examiner

THIN LAYERED HEATING ELEMENT FOR A FLUID PUMP

BACKGROUND

Technical Field

The present disclosure relates to heating elements for fluid pumps. More particularly, the application relates to thin layered heating elements produced in particular via chemical vapor deposition (CVD) or PVD (physical vapor deposition).

Description of the Related Art

A fluid pump with a heating element is often used in domestic appliances, like dish washers and washing machines. In this product segment, the price of a product highly influences the purchase decision of the customers. Thus, it is an overall requirement for designing engineers to take all possible measures to keep the manufacturing costs low, both in view of the components used as well as the manufacturing processes applied.

From EP 2 377 451 A1, a fluid heating pump is known which uses thick film resistors printed onto a metallic cylinder surrounding a pump chamber of the heating pump as heating elements for the pump. Between the metallic tube and the film-resistors there is an insulating layer. Thick film resistors provide high specific loads.

Desired is a heating element for a fluid pump, as well as a fluid pump that provides an improved reaction time as well as an efficient heating operation while providing a compact and robust design and being highly cost efficient.

BRIEF SUMMARY

Provided are a heating element and a fluid pump, wherein the heating element comprises a thin layer having a thickness equal to or smaller than 10 μm.

Thin film technology produced via chemical or physical vapor deposition is known from tooling (antiwear-protection, packaging, barrier-coatings) and optics (UVA protection). However, since there is no need for heated fluid pumps in these areas of technology, the usage of thin film technology for heated fluid pumps has been of no interest and has not been explored so far.

Furthermore, the rather fragile substrate could be considered unsuitable for fluid pump applications which are exposed to vibrations during operation. The difference between the thermal expansion coefficient of the substrate and the heating element is high, such that cracks or fissures can occur, which destroy the heating element. Furthermore, in order to provide a desired resistance and thus a desired heating power of the heating element, the layer thickness of the heating element has to be uniform. Otherwise hot spots may occur.

The inventors, however, discovered that these alleged drawbacks may be overcome and that heatup-rates of up to 100° C. per second can be reached and a specific surface load of up to 50 W/cm$^2$ allows fast reaction times and few energy losses during operation using heating elements exploiting thin film technology.

In a first aspect of the present invention, there is provided a heating element for a fluid pump comprising a substrate, preferably made of glass, in particular quartz glass, or ceramics, a thin layer of monocrystalline, polycrystalline or amorphous material provided on top of the substrate, and electrical contacts provided in contact with the thin layer, preferably made of conductive ink or an electrically-conductive paste, wherein the thin layer has a thickness equal to or smaller than 10 μm. It is possible to provide several thin layers on one substrate being common for these thin layers wherein these thin layers can be connected to an electrical source by common and/or separate electrical contacts. The substrate is preferably made of glass, in particular quartz glass, or ceramics, more particular fused silica, Borosilicate glass or Alumosilicate. A feasible way of producing a suitable substrate in form of a tube-like substrate would be the so-called Vello process. In the Vello process, heated glass runs through an annular slot from the bottom of a feeder. This slot is formed between the round outlet nozzle of the feeder and a height-adjustable hollow needle (also a mandrel). Here, the tube is "inflated" with compressed air. The glass tube which initially emerges in the vertical direction is then deflected into the horizontal position in the free sag. The nozzle mandrel must be adjusted eccentrically to the drawing nozzle in order to avoid uneven wall thicknesses. Therefore, the resulting tube initially has different wall thicknesses, which balance out after the bending. With this method, tube diameters between 1.5 and 80 mm can be generated, which is suitable for application in household appliances such as dish washers or washing machines.

The electrical contact may be provided onto the substrate besides the thin layer, e.g., in direct contact, and/or on top of the thin layer. They may be provided via screen printing using an epoxy resin or via inkjet print using an electrically conducting ink.

In an embodiment, the heating element is formed as a cylinder (or a polygonal tube) with at least partially open ends and/or the heating element is adapted to surround a pump chamber of the fluid pump. Preferably, the heating element is adapted to form an outer wall of a pump chamber of the fluid pump. Thus, the fluid is guided along the inner side of the outer wall of the pump chamber, i.e., at the opposite side the wall where the heating element is positioned.

In a second aspect of the present invention, there is provided a fluid pump or fluid heating pump, respectively, comprising a fluid pump casing having a cylindrical body portion providing a pump chamber with a cylindrical wall, a bottom part and a top part, an inlet and an outlet to the pump chamber, an impeller rotatably mounted about its axis within the pump chamber, the impeller having a central hub with a plurality of vanes extending from the hub, rotation of the impeller causing transference of a fluid admitted into the pump chamber via the inlet through the chamber along the cylindrical wall towards the outlet, wherein the cylindrical wall comprises a heating element according to the first aspect of the invention. The fluid pump casing can alternatively also have a polygonal shape.

In an embodiment, the heating element is surrounded by the pump casing, preferably made of plastic, and a heating reflector, preferably made of metal having further preferably at least partially and at least on its side facing the heating element a smooth (normal/best surface) finish, is provided between the heating element and the cylindrical wall of the fluid pump casing, in particular wherein the heating reflector is grounded. Generally the grounding is solved by a conductive-connection to the medium, this could be realized by a conductive element at the pump casing (e.g., metal inlet-pipe, metal pin protruding through the fluid pump into the pump chamber).

The fluid pump may further comprise a canned electric motor connected with the fluid pump via a non-metallic can wherein the can comprises the metal pin connecting the inside of the pump chamber with an electrically grounded element of the canned electrical motor outside the pump chamber. The can may also form the bottom part of the pump chamber and thus part of the pump chamber casing.

In an embodiment, the impeller comprises a lid with vanes positioned on a side of the lid that is facing away from the impeller, wherein the lid rotates together with the impeller and the vanes of the lid are positioned in the same direction as the vanes of the impeller.

In an embodiment, the fluid pump further comprises fluid guide elements spirally or helically positioned inside the pump chamber to guide the fluid towards the outlet. Preferably, the fluid guide elements are positioned on the outer wall of the inlet or positioned at the inner side of the cylindrical wall of the pump chamber. The fluid guide elements may reduce turbulences within the pump chamber and thus increase the efficiency of the fluid pump because less force is required to guide the fluid towards the outlet.

In an embodiment, the fluid pump further comprises an inner cylinder positioned between the inlet and the fluid pump casing forming an inner chamber and an outer chamber, wherein the inlet is positioned at an end of the pump chamber opposing the impeller and the outlet is positioned at the other side of the pump chamber, wherein the inner cylinder comprises an opening connecting the inner and the outer chamber at the end of the pump chamber opposing the impeller, wherein the fluid guide elements are at least provided at the outer wall of the inner chamber.

In an embodiment, the fluid pump further comprises one or more metal bands in direct contact with the electrical contacts provided on top of the thin layer wherein the metal bands protrude the pump casing at one point to provide an electrical connection to an electrical power source.

In an embodiment, the fluid pump further comprises spring contacts protruding through the fluid pump casing and being in direct contact with the electrical contacts provided on top of the thin layer, the spring contacts providing an electrical connection to a power source.

In an embodiment, the fluid pump further comprises at least one control element measuring a temperature of water to be heated and controlling a status of the heating element based on the measured temperature.

In an embodiment, the fluid pump further comprises at least one safety element measuring a temperature of the heating element and turning-off the heating element if the temperature reaches a predetermined level.

Preferably, the control element is an electromechanical switch in thermal contact with the heating element wherein a) a heat conducting electrical isolator is provided along a connection area between the heating element and the electromechanical switch or b) the electromechanical switch comprises a radiation sensor to measure the temperature of the heating element.

In an embodiment, conducting lines are formed at an outer surface of the pump casing connecting the heating element via the spring contacts with an electrical plug and/or an NTC element as control and/or safety element.

In an embodiment, the cylindrical wall is made of metal wherein at least one control and/or safety element is positioned at the cylindrical wall wherein the control and/or safety element a) is in heat conducting contact with the cylindrical wall to measure the temperature of the metal cylinder wherein the control and/or safety element is encapsulated with an electrically insulating material or b) comprises a radiation sensor to measure the temperature of the metal cylinder.

It shall be understood that the heating element of claim 1 and the fluid pump of claim 3 have similar and/or identical preferred embodiments, in particular, as defined in the dependent claims.

It shall further be understood that a preferred embodiment of the present invention can also be any combination of the dependent claims or above embodiments with the respective independent claim.

These and other aspects of the invention will be apparent from and elucidated with reference to the embodiments described hereinafter.

DETAILED DESCRIPTION

Figure 1A:
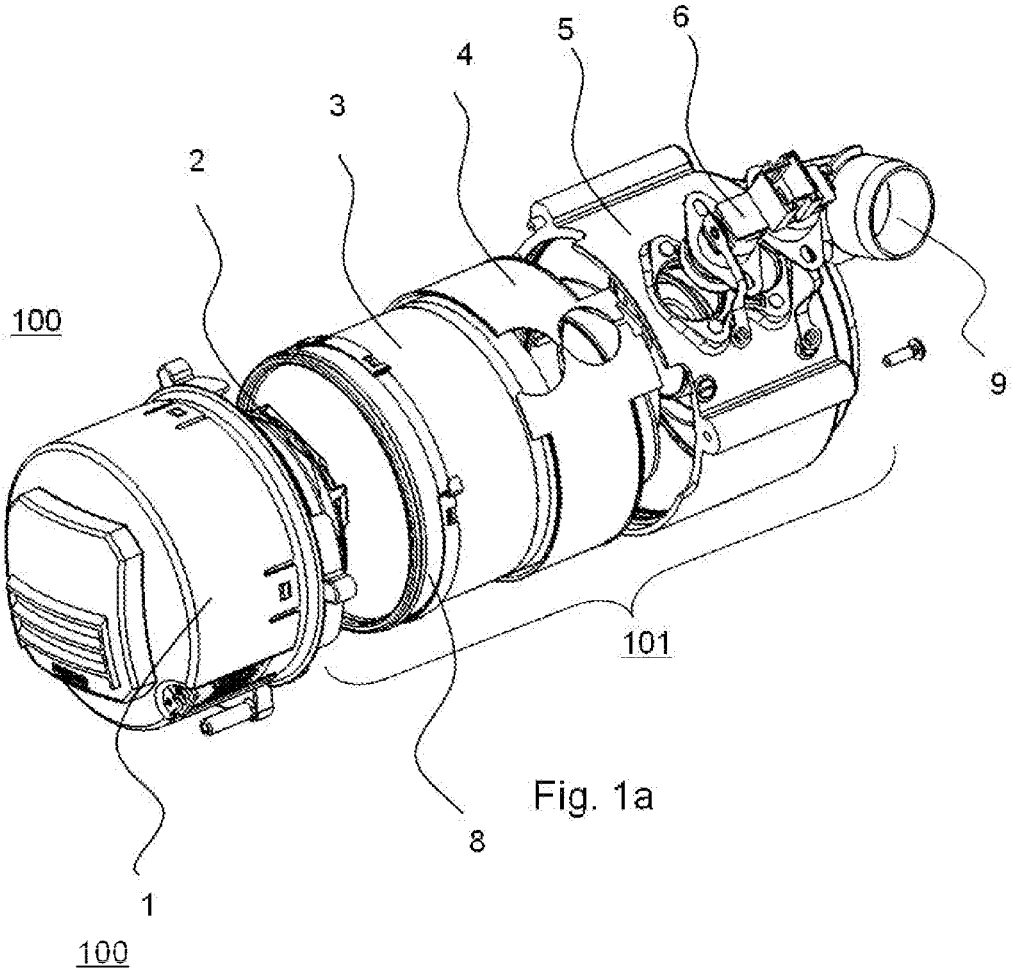
FIGS. 1*a* and 1*b* show exemplarily and schematically a fluid pump system comprising a heating pump and a heating element according to an embodiment of the present invention.
Figure 1B:
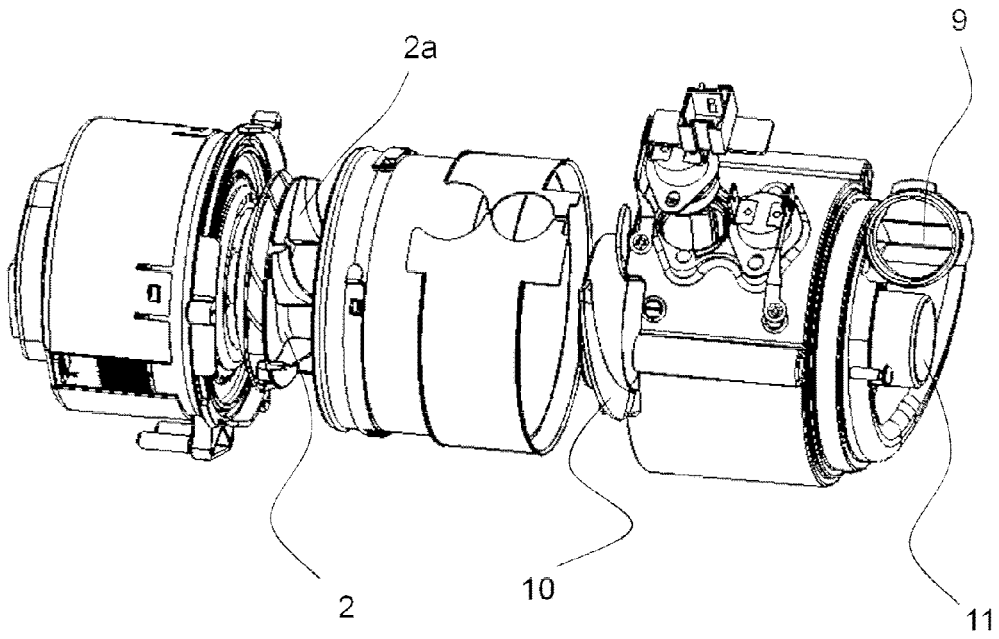

FIGS. 1*a* and 1*b* exemplary and schematically show a pump system 100 comprising a motor unit 1 including preferably an electric motor and a heated fluid pump unit or fluid heating pump 101, respectively. In the following, heating pump unit and fluid pump shall refer to the fluid heating pump 101 only excluding the motor unit 1. The fluid heating pump 101 comprises a pump chamber PC formed by a cylindrical body portion, a bottom portion and a top portion provided in and surrounded by a pump casing 5. The pump casing surrounds a heating element 3 for heating a fluid circulating through the pump chamber PC. Between the heating element 3 and the pump casing a heat shield 4 is provided to protect the pump casing 5 from the heat produced by the heating element. At the pump casing, control and safety devices 6 may be arranged which will be described in the following in more detail. At the bottom portion, an impeller 2 is located which is actuated via a shaft by the motor unit 1. The impeller 2 has a central hub with a plurality of curved vanes or blades 2*a* extending from the hub, such that rotation of the impeller 2 causes transference of a fluid admitted into the pump chamber PC via the inlet 11 through the pump chamber PC towards the outlet 9. The inlet 11 and the outlet 9 may be provided on the same side of the pump chamber PC or on different sides as exemplary and schematically shown in FIGS. 2*a* and 2*b* and FIGS. 4*a* and 4*b*.

Figure 2A:
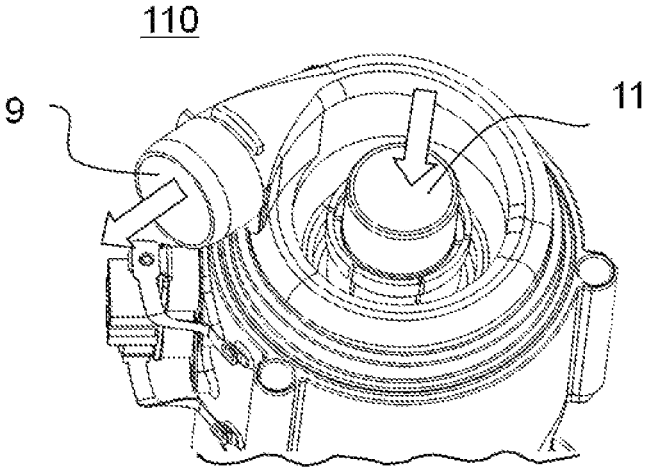
FIGS. 2*a* and 2*b* show exemplarily and schematically a heating pump according to an embodiment of the present invention.
Figure 2B:
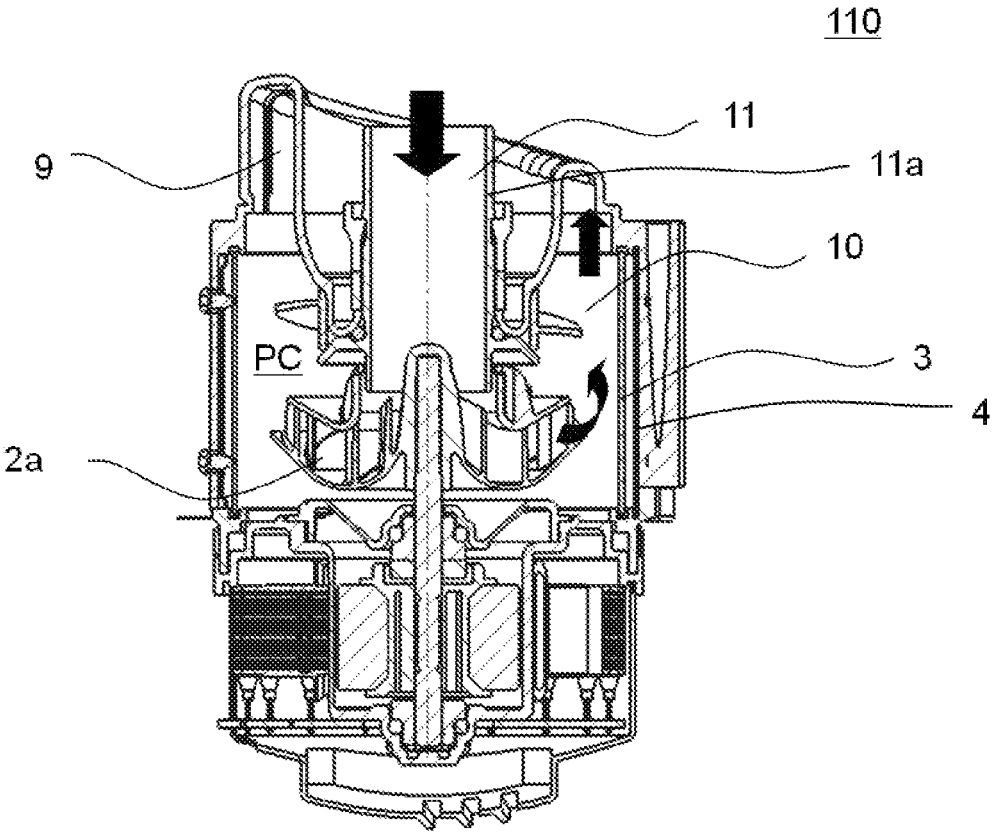

FIGS. 2*a* and 2*b* exemplary and schematically show an example of a fluid heating pump 110 according to an embodiment of the present invention in which the inlet 11 is provided at a central position of the top portion of the pump chamber PC extending in an axial direction towards the impeller 2 and thus guiding the fluid to be pumped towards the impeller 2 during operation. The outlet 9 is also provided on the top portion of the pump chamber PC. It is formed in a spiral manner around the inlet 11. The fluid entering the pump chamber PC via the inlet 11 is radially guided into the pump chamber PC via the impeller 2. The vanes 2*a* may be arranged such that the fluid entering into the pump chamber PC comprises a rotational flow component.

Figure 3A:
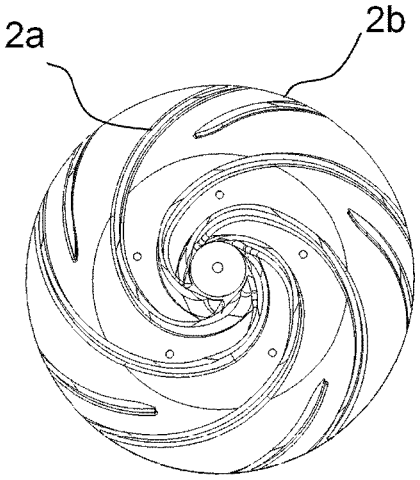
FIGS. 3*a*, 3*b* and 3*c* show exemplarily and schematically an impeller according to an embodiment of the present invention.
Figure 3B:
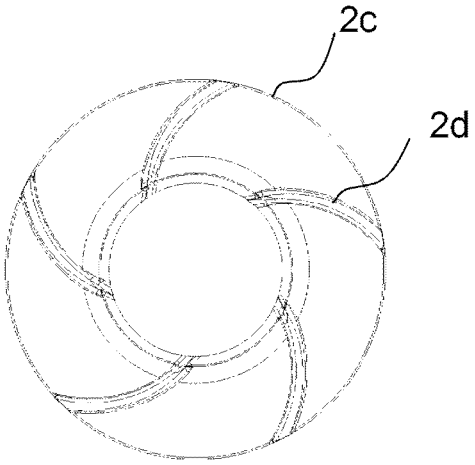
Figure 3C:
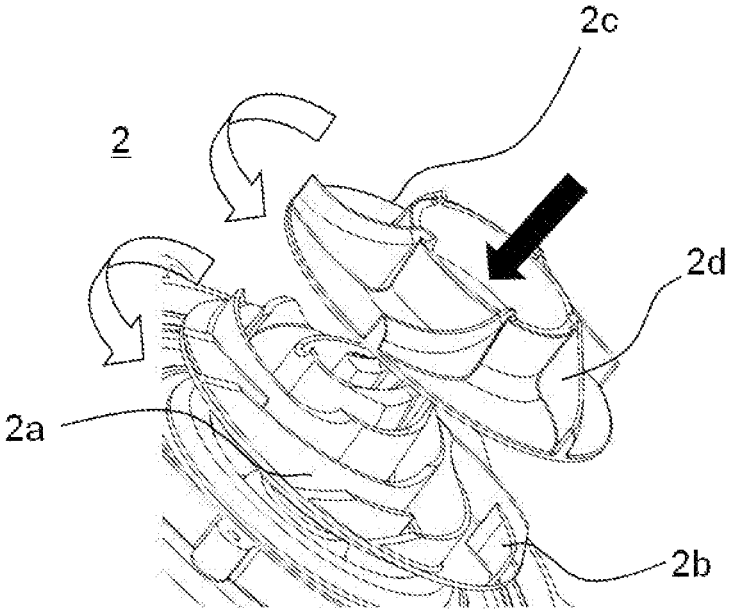

FIG. 3*a* exemplary and schematically shows an impeller 2 having a plurality of vanes 2*a* and splitters 2*b*. Preferably, the cover portion 2*c* of the impeller 2 shown exemplary and schematically in FIG. 3*b* which rotates together with the impeller 2 as indicated in FIG. 3*c* also comprises vanes 2*d* supporting the movement of the fluid towards the outlet. The fluid thus moves towards the outlet 9 in a spiral manner. At the outside of the cylindrical wall of the pump chamber PC, the heating element 3 is provided. Upon passing along the wall of the heating chamber, heat from the heating element 3 is transferred to the fluid.

Figure 4A:
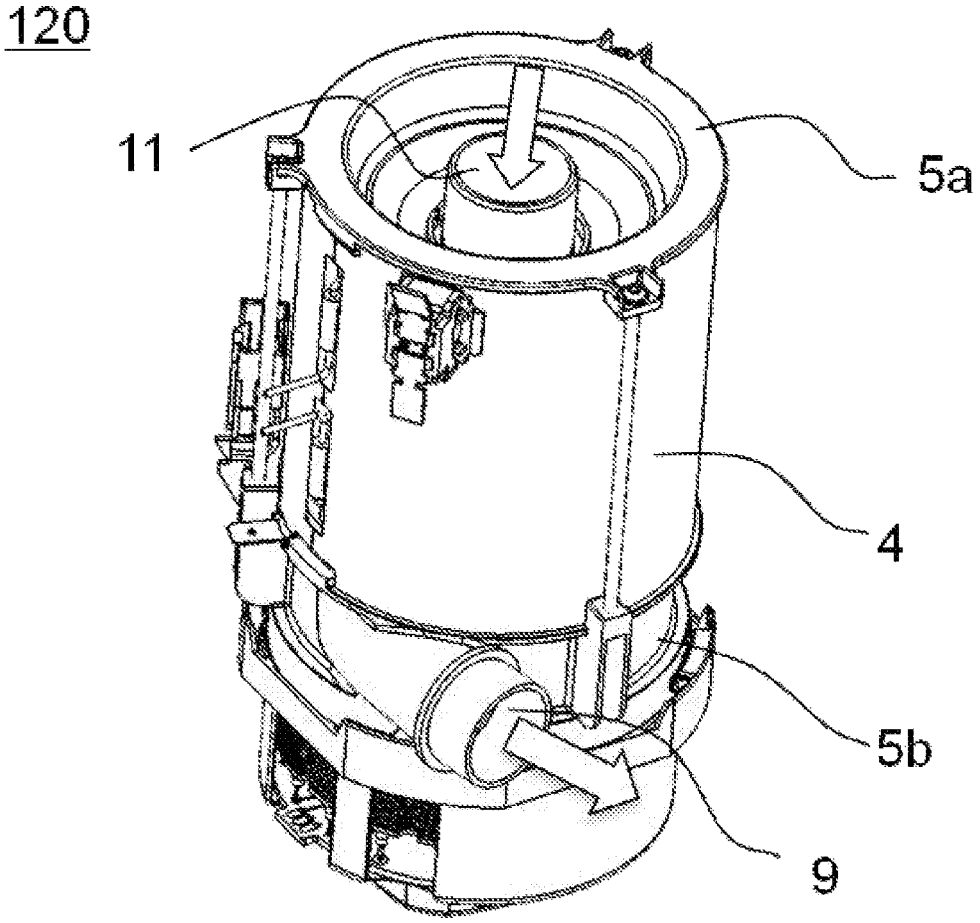
FIGS. 4*a* and 4*b* show exemplarily and schematically a heating pump according to an embodiment of the present invention.
Figure 4B:
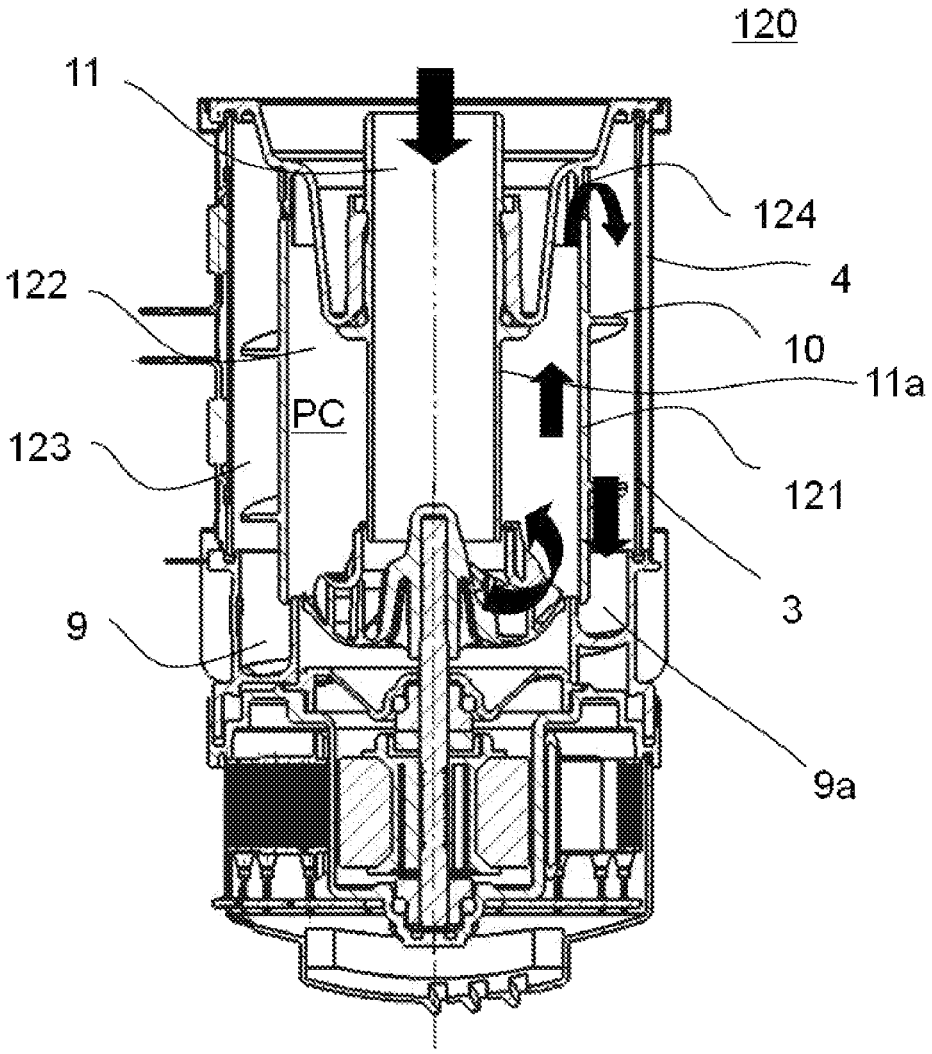

An alternative arrangement of the inlet and outlet is exemplary and schematically shown in FIGS. 4*a* and 4*b* for a fluid heating pump 120. Here, the fluid enters the pump chamber PC via the inlet 11 as in the embodiment shown in FIGS. 2*a* and 2*b* for fluid heating pump 110. However, the outlet 9 is provided at a position radially outside of the impeller 2. The impeller 2 may be the same as described for fluid pump 110.

The pump chamber PC comprises an inner cylinder 121 separating an inner chamber 122 from an outer chamber 123. The fluid first enters the inlet 11—preferably—designed as a tube 11*a* extending to the impeller 2 and flows inside the tube 11*a* towards the impeller 2 in the axial direction of the pump chamber PC wherein the outside of the tube 11*a* forms the inner wall of the inner chamber 122. At the impeller 2, the fluid changes its flowing direction and enters the inner chamber 122 being arranged coaxially to the tube 11*a* and flows then towards an opening 124 between the inner chamber 122 and the outer chamber 123 on the top portion of the pump chamber PC opposite the impeller 2. Here, the fluid changes its flowing direction once again and enters the outer chamber 123 which is coaxially arranged to the inner chamber 122 and the inner wall of which is formed by the outside of the inner chamber 122. The flow in the outer chamber 123 is thus in the opposite direction as the flow in the inner chamber 122 and in the same direction as the flow in inlet tube 11*a*. In the outer chamber 123, the fluid flows towards the outlet 9 formed by a ring-shaped space 9*a* surrounding the impeller 2. Guiding elements 10 can be provided at the outer and/or inner side of the tube 11*a* and/or at the outer and/or inner side of inner chamber 122 in order to introduce radial flow components to the fluid.

A heating element 3 is provided at the outside of the outer wall of the outer chamber 123 transferring heat to the fluid. The fluid may transfer some of the heat to the inner wall of the outer chamber 123 which is the outer wall of the inner chamber 122. Accordingly, also the fluid in the inner chamber 122 is preheated via the wall of the inner cylinder 121. Since the fluid has a longer path through the pump chamber PC, the amount of heat absorbed by the fluid on its path through the pump chamber PC is increased.

In all previously described embodiments shown in FIGS. 1*a* and 1*b*, FIGS. 2*a* and 2*b* as well as FIGS. 4*a* and 4*b*, as well as in all following embodiments, the heating element 3 of the fluid heating pumps 101, 110, 120 is provided at least on a part of the outer wall of the pump chamber PC, preferably on the whole cylindrical outer wall of the pump chamber PC formed by the outer wall of the outer chamber 123. The heating element 3 is made of an electrically insulating substrate 31, preferably made of ceramics or quartz glass, as exemplary and schematically shown in FIG. 5. Quartz glass, in particular fused silica but also Borosilicate glass or Alumosilicate, have a low coefficient of thermal expansion and thus a high thermal shock resistance. The high melting temperature of the above mentioned materials allows the production of components, pipes and vessels which may sustain temperatures up to 1.400° C. without losing their shapes. Suitable ceramics may be aluminum oxide or another metal oxide providing a similarly low coefficient of thermal expansion and high thermal shock resistance and high melting points. The person skilled in the art will appreciate that the above listed examples of suitable materials are not construed to be limiting and that other materials with similar properties can be equally used.

The substrate may preferably have a cylindrical shape. Alternatively also a polygonal shape is possible wherein the ratio between diameter D and wall thickness S can be in the range of 10 up to 300, preferably in the range of 60 to 100, and more preferably in the range of 30 to 50. In an exemplary embodiment the substrate may have a diameter of 75 mm and the wall thickness is 2 mm or 1.5 mm.

Figure 5A:
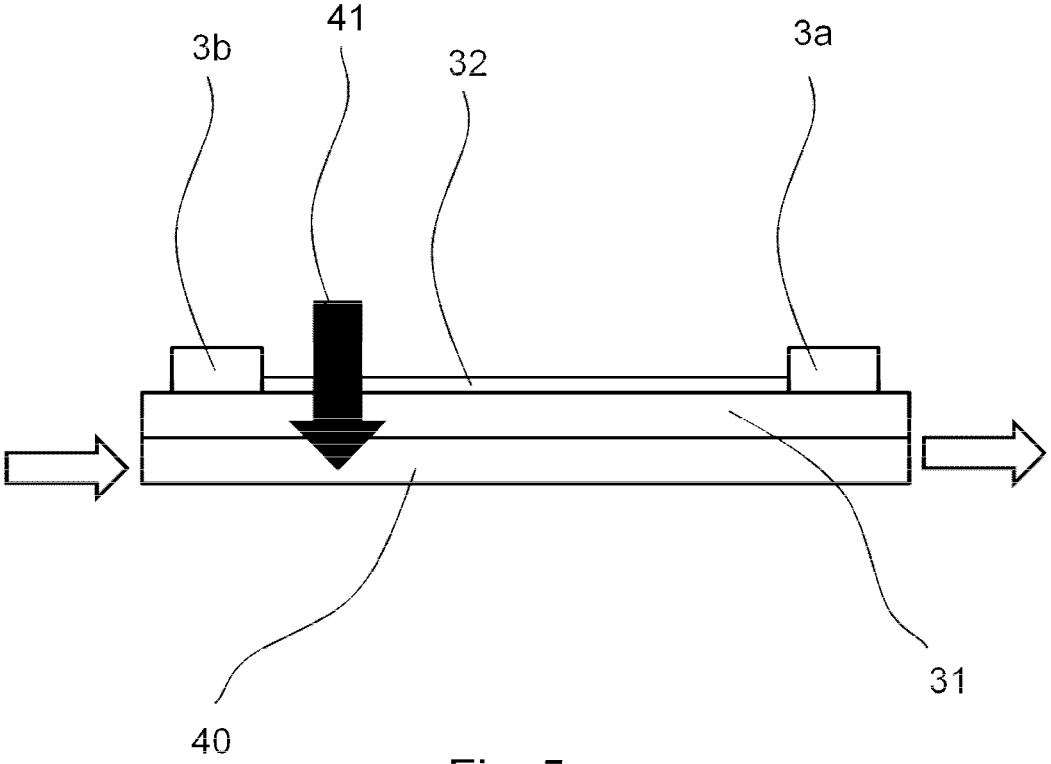
FIGS. 5*a* and 5*b* illustrate exemplarily and schematically a heating element according to an embodiment of the present invention.
Figure 5B:
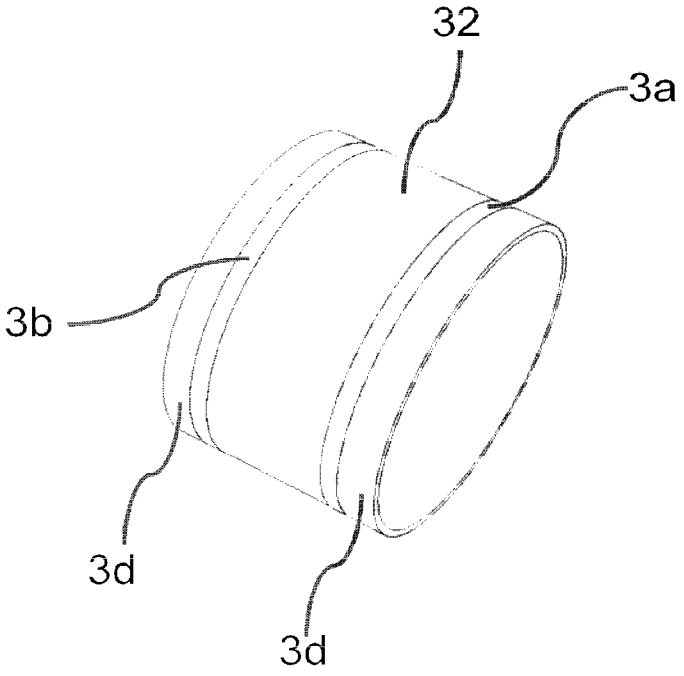

On top of the substrate 31, i.e., facing in the radial direction to the outside of the pump casing 5, a thin resistive layer 32 made of a monocrystalline, polycrystalline or amorphous material is provided for instance using a chemical or physical vapor deposition method (CVD or PVD, e.g., CD/DVD manufacturing via SPUTTERN-method). CVD is a generic name for a group of processes that involve depositing a solid material from a gaseous phase. Precursor gases (often diluted in carrier gases) are delivered into the reaction chamber at approximately ambient temperatures. As they pass over or come into contact with the heated substrate, they react or decompose forming a solid phase which is deposited onto the substrate. The substrate temperature is critical and can influence what reactions will take place. The resulting layer thickness of the thin layer 32 is smaller than 10 μm, preferably smaller than 5 μm and more preferably smaller than 1 μm depending on required resistance. As shown in FIGS. 5*a* and 5*b* electrical contacts 3*a*, 3*b* are provided next to the thin layer 32 onto the substrate 31, for instance via screen printing using an epoxy resin or via inkjet print using an electrically conducting ink. Next to the electrical contacts 3*a* and 3*b* the substrate comprises regions 3*d* which are not covered by the thin layer 32. These regions are referred to as cold regions and may be used to implement contacts or other devices which are not suitable for exposure to the high temperatures which may be reached by the heating element.

The heating rates provided by the heating element 3 are up to 100° C./sec and a specific surface load of up to 50 W/cm$^2$ can be reached. Establishing a contact to the heating element 3, in particular to the electrical contacts 3*a* and 3*b*, may be achieved via metal bands 8*a*, 8*b* which in case of a cylindrical heating element 3 as described above may be provided circumferentially as exemplary and schematically shown in FIG. 6*a*. In this embodiment, the metal rings 8*a*, 8*b* are positioned within the fluid pump casing 5 (see FIG. 1*a*). The metal bands 8*a*, 8*b* provide contact points 8*c* as exemplary and schematically shown in FIG. 6*b*. The metal bands 8*a*, 8*b* can be connected with respective conductors to control/safety elements which will be described in detail in the following, as well as to a power source providing power to the heating element 3. The current consumption of the heating element 3 usually ranges between 5 and 20 A depending on the power spectrum. In the embodiment shown in FIG. 6*b*, the heating element 3 is fixedly arranged with the fluid pump casing 5 with suitable seals 12, such that the metal bands 8*a*, 8*b* can be provided inside the fluid pump casing 5. The seals are inserted in a recess portion of the top part 5*a* and the bottom part 5*b* of the pump chamber PC. The seals 12 are preferably U-shape such that they provide suspension in axial and radial direction for the glass or ceramic cylinder of heating element 3.

Figure 6A:
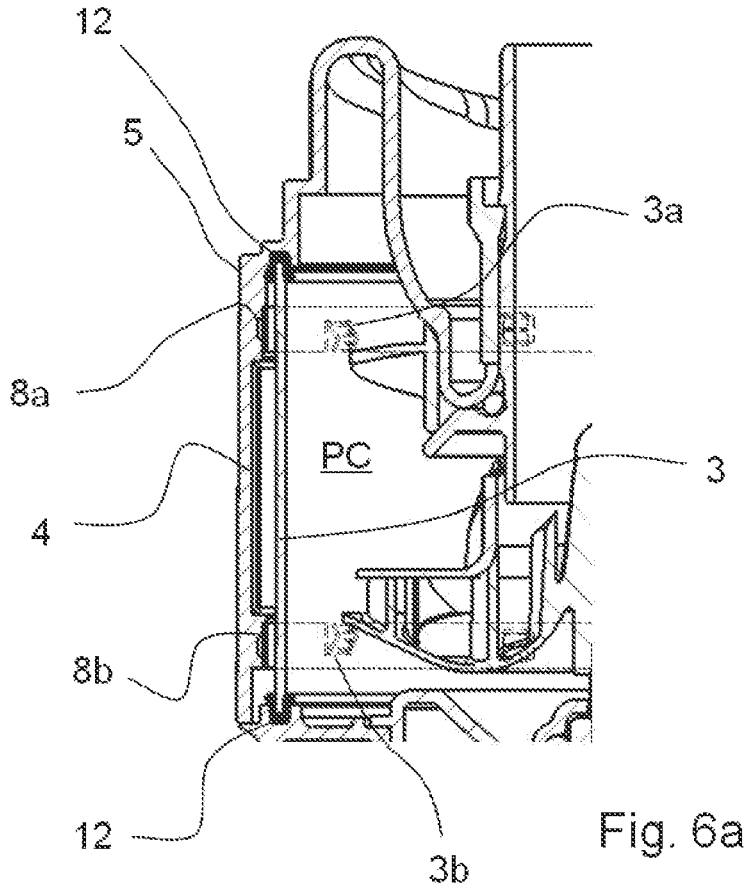
FIGS. 6*a*, 6*b* and 6*c* show exemplarily and schematically an arrangement to contact the heating element according to an embodiment of the present invention.
Figure 6B:
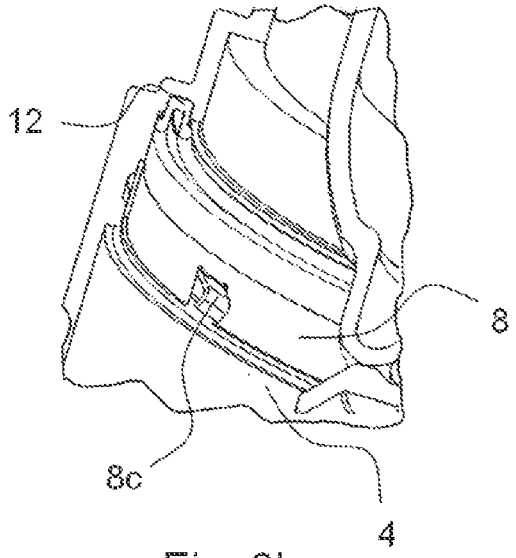
Figure 6C:
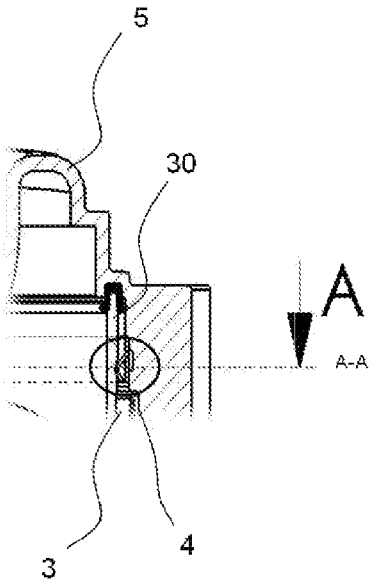
Figure 6C:
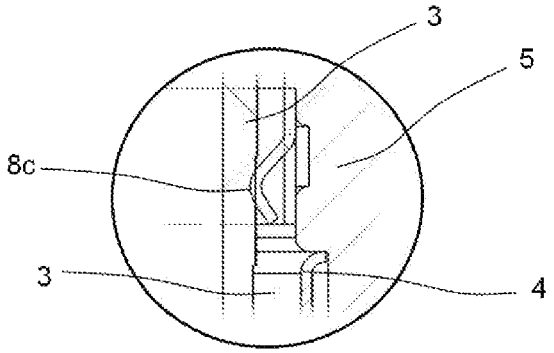
Figure 6C:
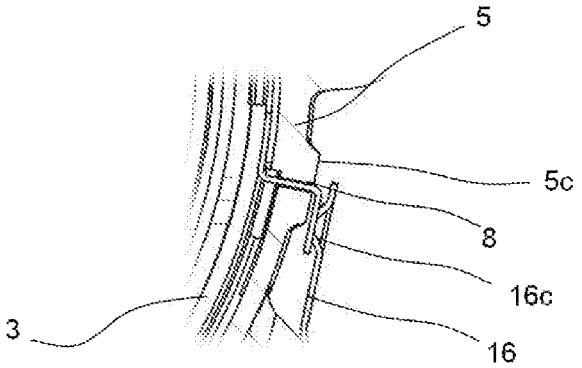

The material of the fluid pump casing 5 in this embodiment is preferably a non-flammable material such as a polyamide based compound, e.g. PP, PA, PPS, PET, etc. FIG. 6*a* also shows a cylindrical heat reflector 4 protecting the fluid pump casing 5 from heat generated by heating element 3. The heat reflector 4 is preferably made of a metal material and being preferably provided on its inner wall facing to the heating element 3 at least partially with a mirror finish. In the embodiment shown in FIG. 6*a*, the metal shield or heat reflector 4 is provided as a metal cylinder which also functions as a brace between the heating chamber's top and bottom sides and thus supports the rigidness of the fluid pump casing 5. In an alternative embodiment, the fluid pump casing 5 may be formed only of the metal cylinder 4 and the pump bottom and top portion without having a further cylindrical cover made of plastic. Such an arrangement is shown inter alia in FIG. 4*a*. Here, the fluid pump casing is formed of the top part 5*a*, the metal shield 4 and the bottom part 5*b*, wherein top and bottom part may be made of a plastic material such as a polyamide based compound.

The metal shield cylinder used as heat reflector 4 in both embodiments previously presented may furthermore be used for electrical grounding.

Figure 7:
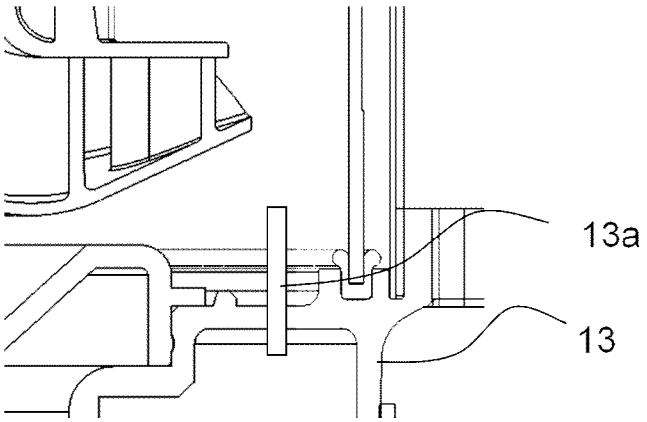
FIG. 7 shows exemplarily and schematically a variant to ground the fluid via the bottom portion of the fluid pump according to an embodiment of the present invention, and also the fixation of the substrate comprising the heating-element.

Here the idea is the following, that in case of failure (e.g., motor-defect) the heating-element 3 shall withstand very high temperatures (>1000° C.). So in that case first the sealings 12 will collapse and became leaky. Then, the medium (e.g., water) will flow through the leaky spots and get in contact with the grounded metal shield. The grounding functionality may also be provided by the top portion 5*a* or the bottom portion 5*b* of the pump chamber PC via a metal contact 13*a* as exemplary and schematically shown in FIG. 7. The metal contact 13*a* that is in direct contact with the fluid may be provided at the bottom portion 5*b* separating the motor unit 1 from the pump chamber PC. The metal contact 13*a* can be press fitted, glued or molded with the bottom portion. The bottom portion 5*b* may also be formed by a non-metallic can 13 provided as part of the motor unit 1 separating the motor unit 1 from the pump chamber PC, in particular for a wet running motor. However, also a dry running motor could be used as a power-drive.

It shall be understood that the heat reflector 4 can be provided on a fluid heating pump independent from its specific design.

Figure 8A:
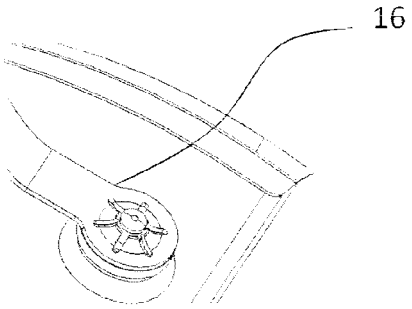
FIGS. 8*a* and 8*b* show exemplarily and schematically an arrangement to contact the heating element according to an embodiment of the present invention.
Figure 8B:
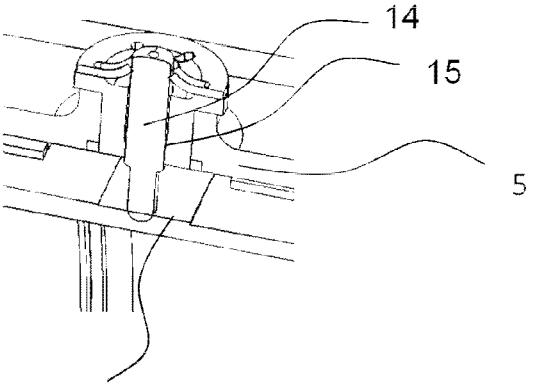

Alternative to the metal bands 8*a* and 8*b*, the heating element 3 may also be contacted by spring contacts 14 as exemplary and schematically shown in FIGS. 8*a* and 8*b*. In this embodiment, the fluid pump casing 5 is provided with connectors 15 formed as bushes which may either be molded with the fluid pump casing 5 or subsequently inserted, e.g., pressed. The connectors 15 are made of an electrically conducting material, e.g., plastic, metal or a compound material. Preferably, the connectors 15 are made of a non-flammable material such as a polyamide based compound such that the fluid pump casing 5 can be made of a commonly used material. Spring contacts 14 may be inserted into the connectors 15, wherein the spring contacts 14 have predetermined spring deflections to compensate for manufacturing tolerances and to establish a permanent contact. Preferably, the feeler head of the respective spring contacts 14 is waffle shaped. The connection to control and/or safety elements may be established via contact sheets 16 as shown in FIG. 8*a*. The contact between the contact sheets 16 and the spring contacts 14 may be realized by soldering, welding or as indicated in FIG. 8*b* via a speed nut connection.

Figure 9A:
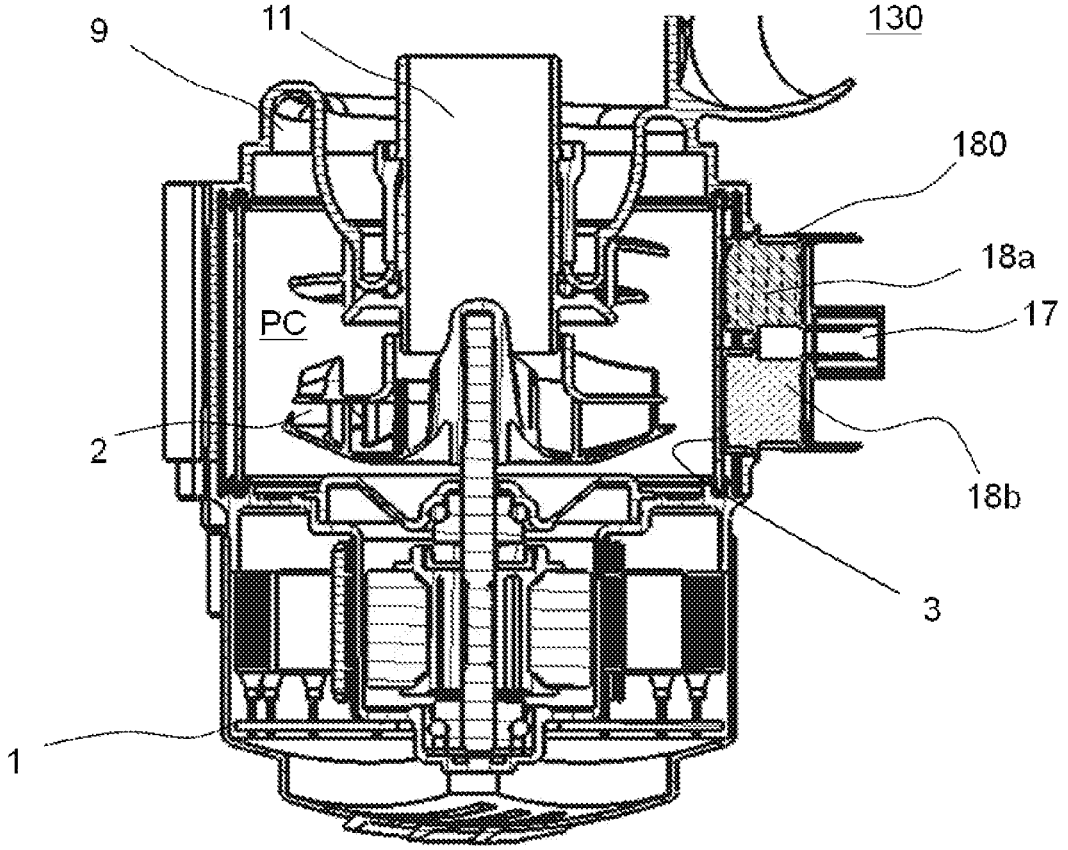
FIGS. 9*a* to 9*e* show exemplarily and schematically an arrangement of a control and safety unit for the heating element according to an embodiment of the present invention.

All the previous fluid heating pumps 101, 110, 120 may be provided with respective control/safety elements. FIG. 9*a* shows schematically and exemplary a fluid heating pump 130 with a control and safety unit 180 using a radiation sensor 18*a* and a contact sensor 18*b* connected via a plug insert, a plug link or plug bridge 17 to provide temperature measurement functionality as well as safety functionality, e.g., fuse functionality.

Figure 10A:
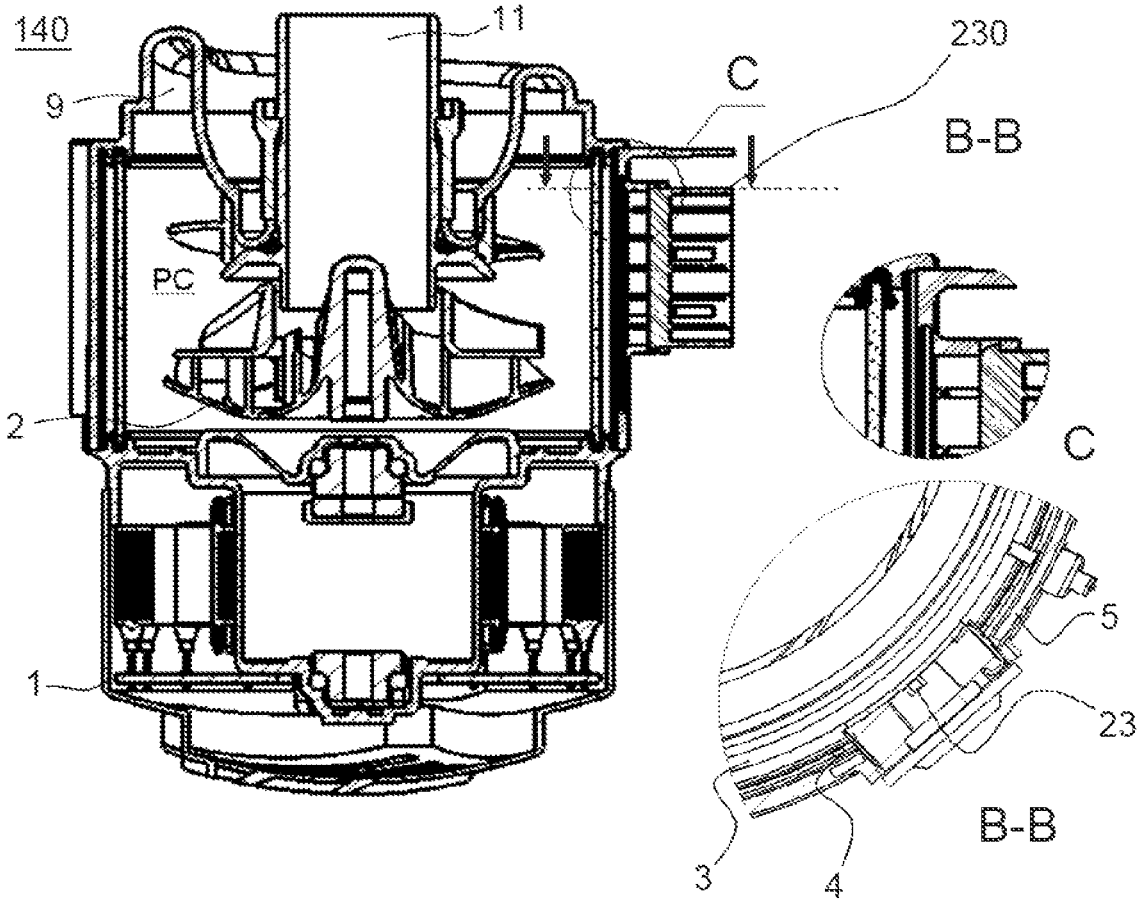
FIGS. 10*a* to 10*g* show exemplarily and schematically a further arrangement of a control and safety unit for the heating element according to an embodiment of the present invention.

A fluid heating pump 140 illustrated schematically and exemplary in FIG. 10*a* shows an alternative embodiment with a control and safety unit 230 using NTC technology to implement temperature driven control functionality as well as safety functionality. Both embodiments will be described in the following in more detail.

Figure 9B:
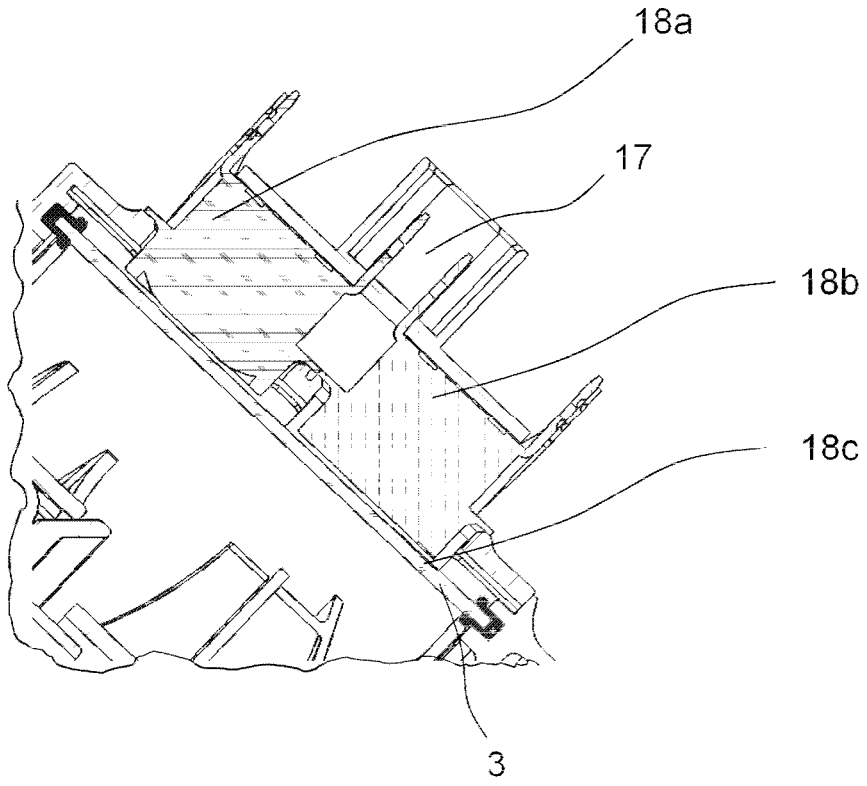
Figure 9C:
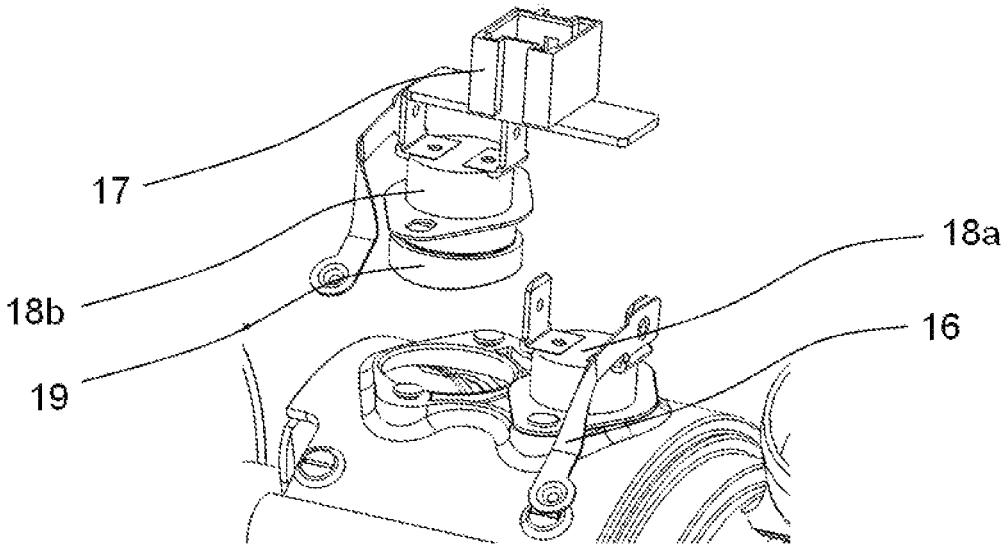
Figure 9D:
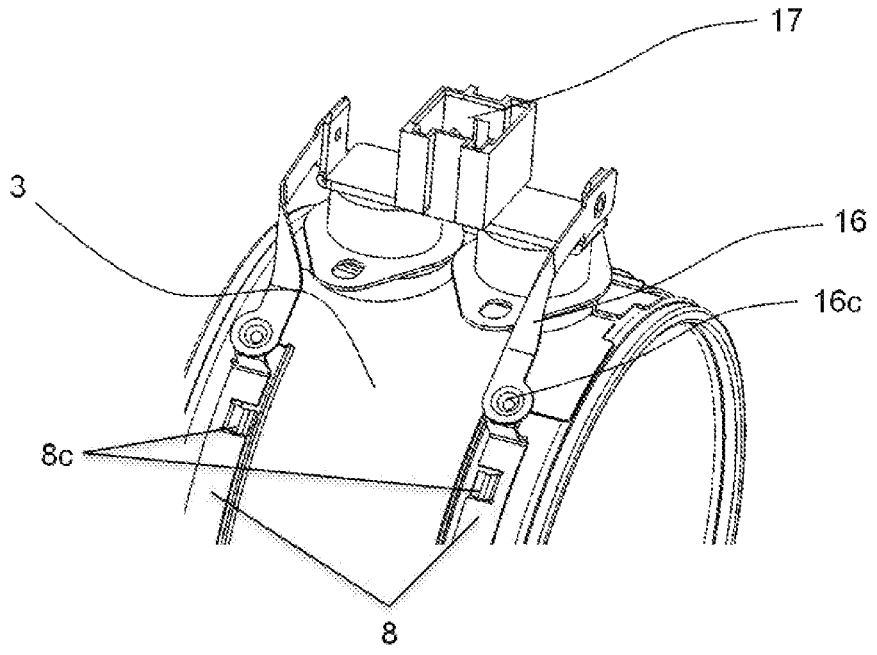
Figure 9E:
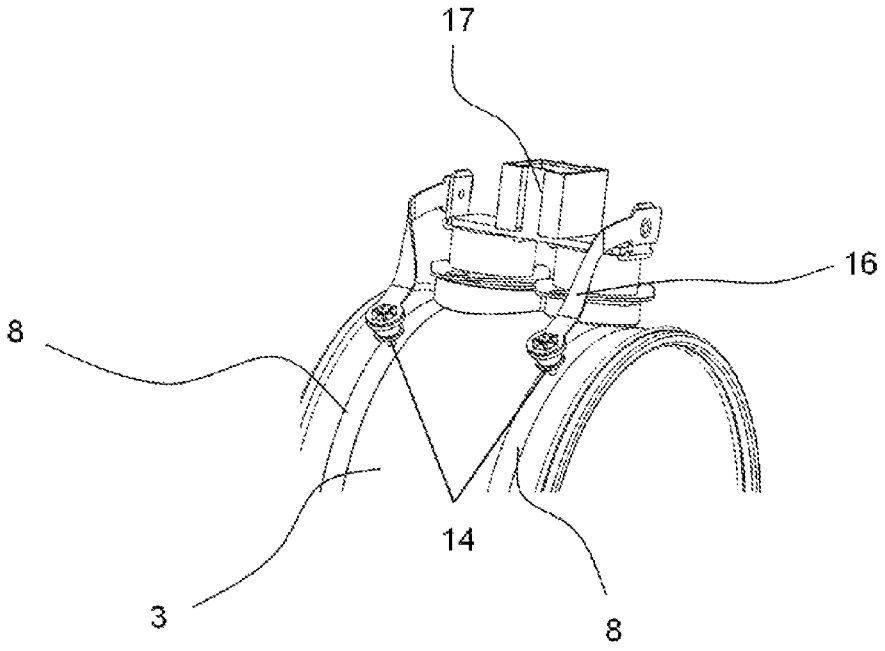

FIG. 9*b* shows a detailed view of a radiation and contact sensors 18*a*, 18*b* realized with known electromechanical switch elements. The radiation sensor 18*a* is not in direct contact with the heating element 3 but measures the temperature using radiation heat. The contact sensor 18*b* is in heat conducting contact with the heating element 3. Since the heating element 3 is electrically conducting, a thermally conducting but electrically insulating material 18*c* has to be provided between the heating element 3 and the contact sensor 18*b*. This material may for instance be a product based on polyphenylene sulphide. It may be provided in the form of a support 19 covering the lower portion of the sensor casing 18*b* as shown in FIG. 9*c*. The two sensors 18*a* and 18*b* are both connected to plug insert 17, wherein common RAST 2.5/5 connectors may be used. As shown in FIGS. 9*c*, 9*d* and 9*e* the plug insert 17 also provides electrical power to the heating element 3 via metal sheets 16, wherein both previously discussed connections via metal bands 8*a* and 8*b* as shown in FIG. 9*d* or spring contacts 14 as shown in FIG. 9*e* may be used.

Figure 10B:
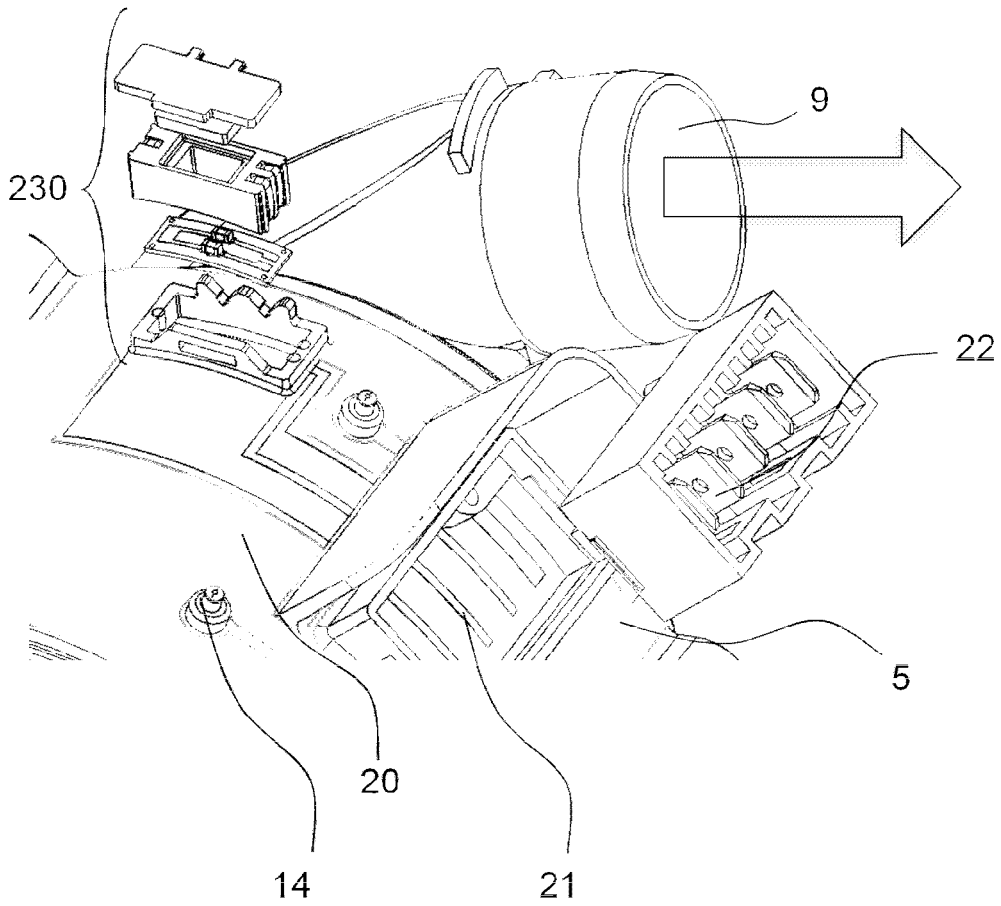
Figure 10C:
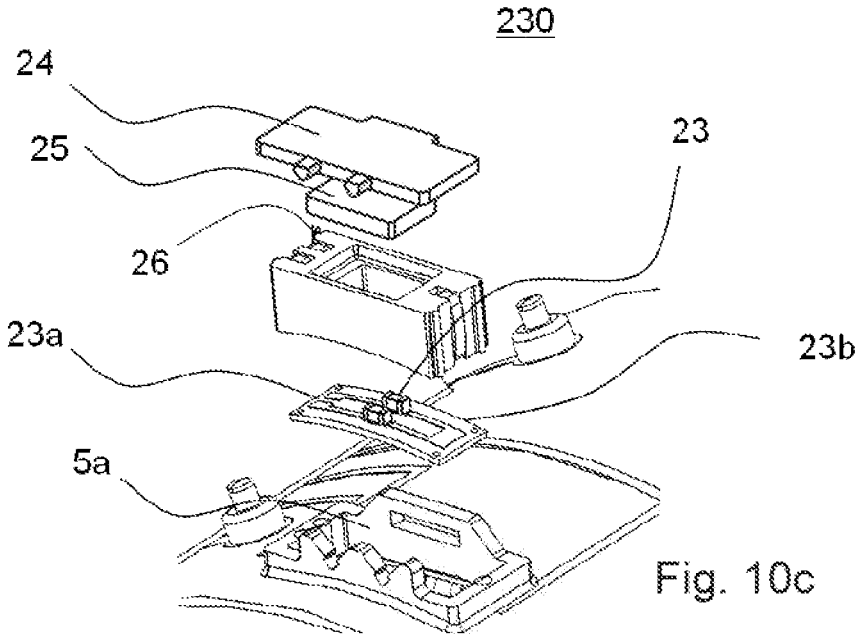
Figure 10D:
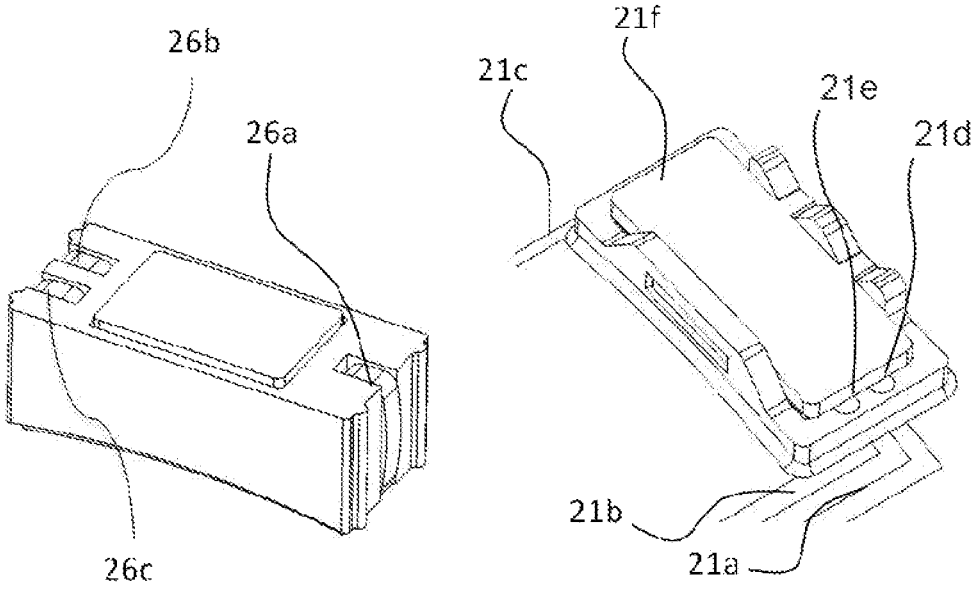
Figure 10E:
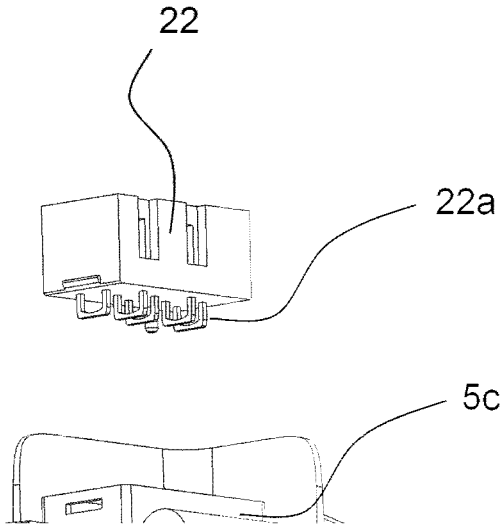
Figure 10F:
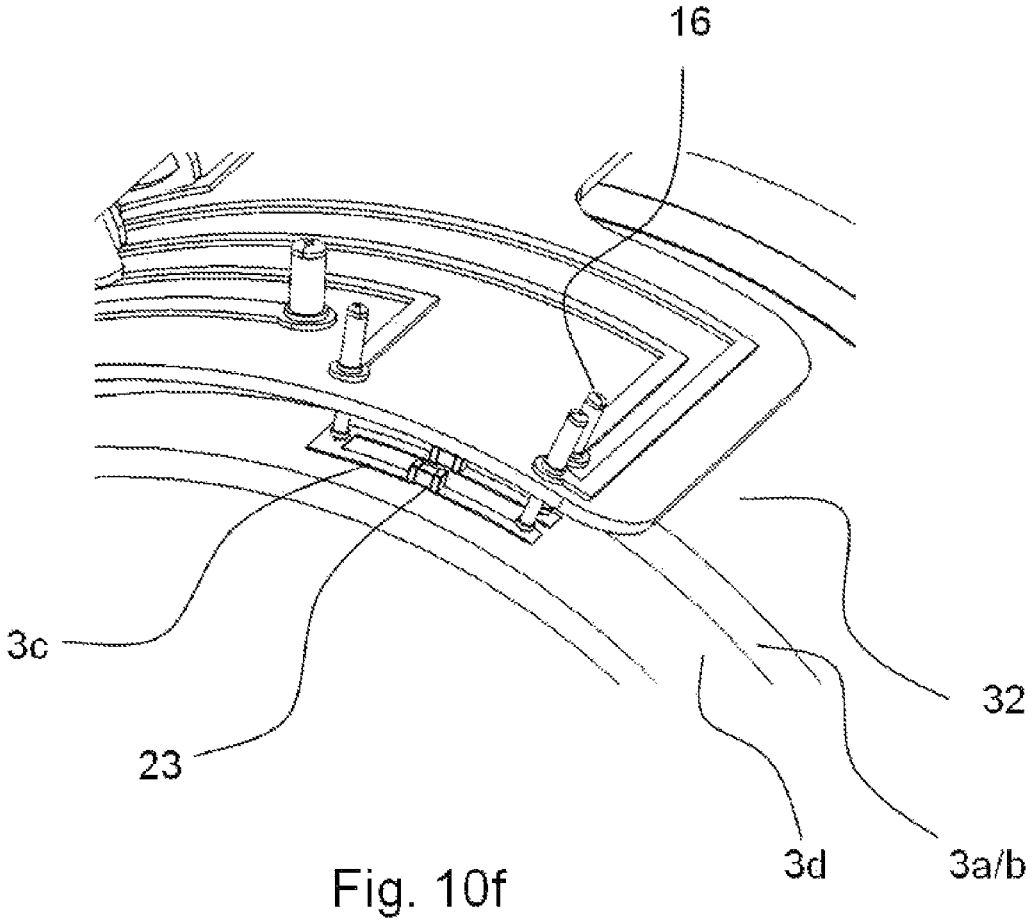

An alternative way of contacting the heating element 3 are contact lines 21 imprinted on the fluid pump casing 5 which conduct current from a plug connector 22 to the heating element 3 via for instance spring contacts 14 as shown in FIG. 10*b*. Instead of being directly imprinted on the fluid pump casing 5, the contact lines 21 may be provided on a carrier plate 20 which is made of a non-flammable material, for instance a polyamide based compound. This carrier plate 20 may subsequently be fixed to the fluid pump casing 5, for instance by molding the carrier plate 20 with the fluid pump casing 5. The conducting lines 21 may not only be used to provide power to the heating element 3, but also to connect a control/safety unit 230 which may be provided in the hot area as well as in the cold area (transition area) 3*d* of the heating element as indicated in FIG. 5*b*. The hot area is an area of the cylindrical wall that is covered by the heating element 3. The cold area 3*d* is an area of the cylindrical wall not covered by the heating element 3, for instance a region next to the heating element 3 at an upper or lower end of the cylindrical chamber but preferably in contact with the fluid inside the pump chamber PC. As shown in FIG. 10*c*, NTC element 23 is provided on an electrically insulating, but heat conducting layer 23*b*, e.g., a thin film made of polyimide, such as a Kapton film. The contacts 23*a* for the NTC elements 23 are also provided on that film layer 23*b*, e.g., via screen printing. The film layer 23*b* is connected with a contact casing 26, e.g., glued, clamped, etc. The thin layer and the contact housing are inserted into a corresponding support 5*c* of the fluid pump casing 5. In order to compensate for manufacturing tolerances a resilient member 25, e.g., a rubber material, a spring, etc., and a cover element 24 are used to provide the necessary contact pressure as indicated in FIG. 10*c*. The connection between the contact casing 26 and the contact lines 21 is exemplary and schematically shown in FIG. 10*d*. Contact lines 21*a*, 21*b* and 21*c* are connected via contact points 21*d*, 21*e* and 21*f* to contact point 26*a*, 26*b* and 26*c* of contact casing 26. They may either be molded with the fluid pump housing 5 or they may be subsequently added. The plug connection 22 provides contact pins 22*a* on its lower side. Upon insertion of the plug connection 22 these contact pins 22*a* are mechanically deformed to provide a permanent contact. The plug connector 22 is latched in the corresponding female plug connection 5*b* in the fluid pump casing as shown in FIG. 10*f*. Alternatively the plug connection could be provided as a screw or clamp/crimp connection. The contact pins 22*a* may alternatively be provided as spring contacts.

Figure 10G:
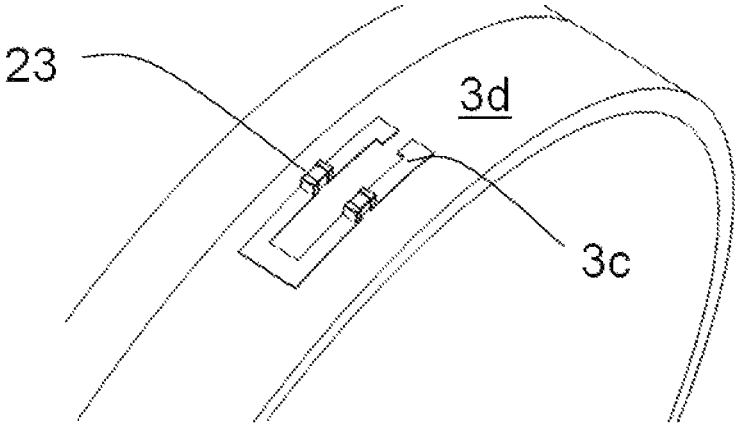

As already indicated hereinabove, the control and safety unit 230 may also be provided directly onto the heating element 3 without the provision of a carrier unit as shown in FIG. 10*g*. In that case a contact layer 3*c* is provided in a cold area 3*d* of cylindrical wall next to the heating element 3. The NTC element 23 is connected with the contact layer 3*c* via a suitable gluing connection. The connection to the plug connector 22 may again be provided via contact pins 14*a*, either directly or via additional contact lines as shown in FIG. 10*f*. The contact pins 14*a* are first fixed by a suitable snug fit or—as alternative—are secured with a soldering or welding point or the like.

Figure 11:
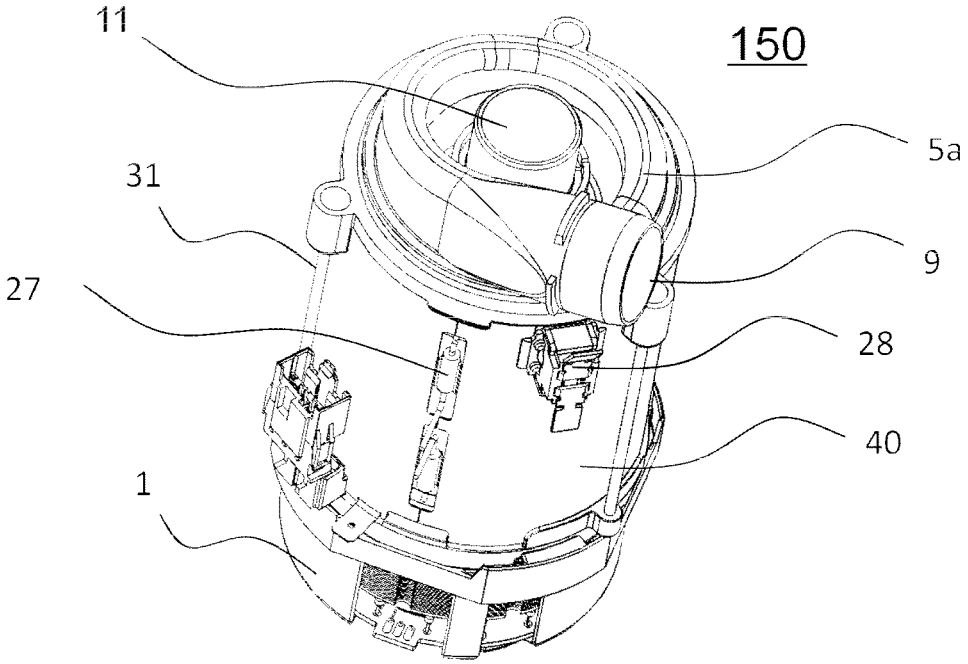
FIG. 11 shows exemplarily and schematically a further arrangement of a control and safety unit for the heating element according to an embodiment of the present invention.
Figure 12:
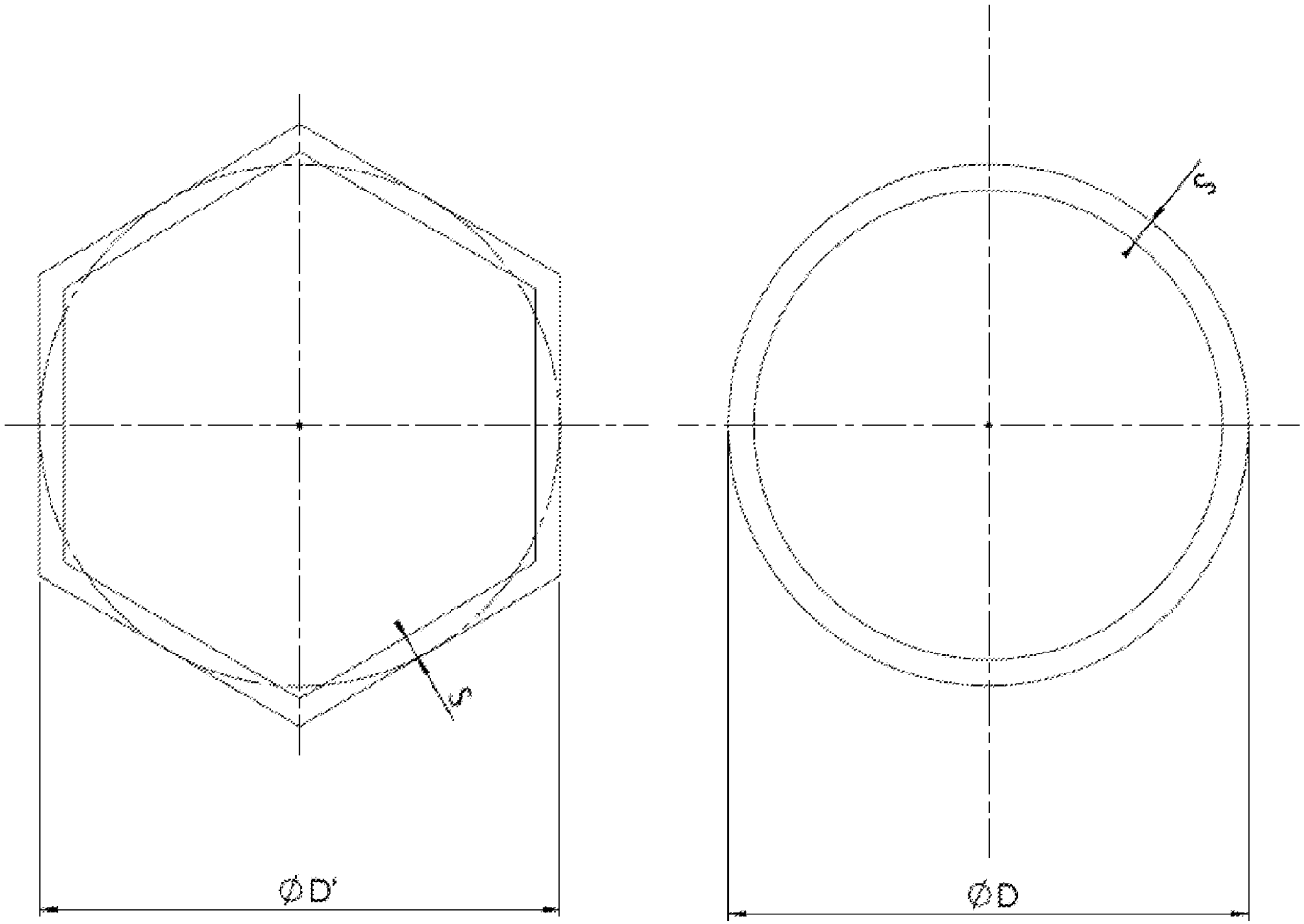
FIG. 12 shows two sketches regarding the ratio between diameter and wall thickness.

A further alternative of implementing control and safety functionality is shown in FIG. 11 where a temperature monitoring and control/safety element 27 and/or 28, such as a fuse, are clamped, welded, soldered or otherwise fixed to a metal cylinder 40. In this embodiment the fluid pump 150 does not have a cylindrical cover made of plastic as shown in the previous embodiments. Instead, the fluid pump casing 5 includes a top portion 5*a* and bottom portion (not shown) as well as a metal cylinder 40 therebetween. The metal cylinder 40 may be screwed or clamped between the motor unit 1 and the top portion 5*a* of the fluid pump casing. The heating element 3 is fixed with seals as shown for previous embodiments such as the one illustrated in FIG. 6*a*. The temperature monitoring and control/safety element 27 and/or 28 may comprise one or more fuses. For instance, there may be one fuse for each contact of the heating element 3. The temperature monitoring and control/safety element 27 and/or 28 may be clamped or pressed to the metal cylinder 40 and is encapsulated with an electrically insulating but thermally conducting layer.

The control element 28 may for instance be a welded thermostat, which is in direct or indirect contact with the heating element, e.g., using contact or radiation heat.

Figure 13A:
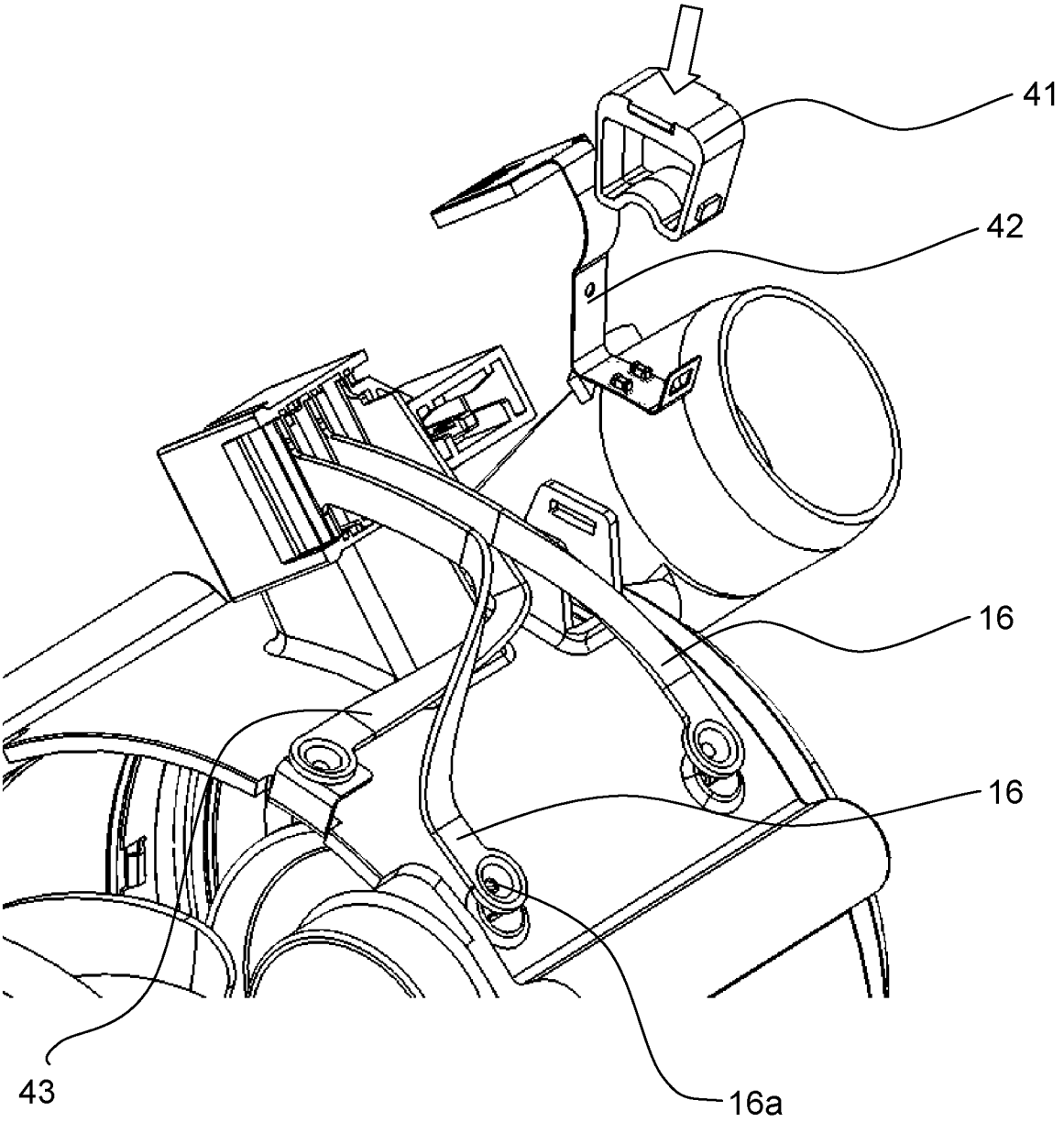
FIGS. 13*a* to 13*c* show a variant of an NTC element according to a further embodiment of the present invention, in particular the NTC connector.
Figure 13B:
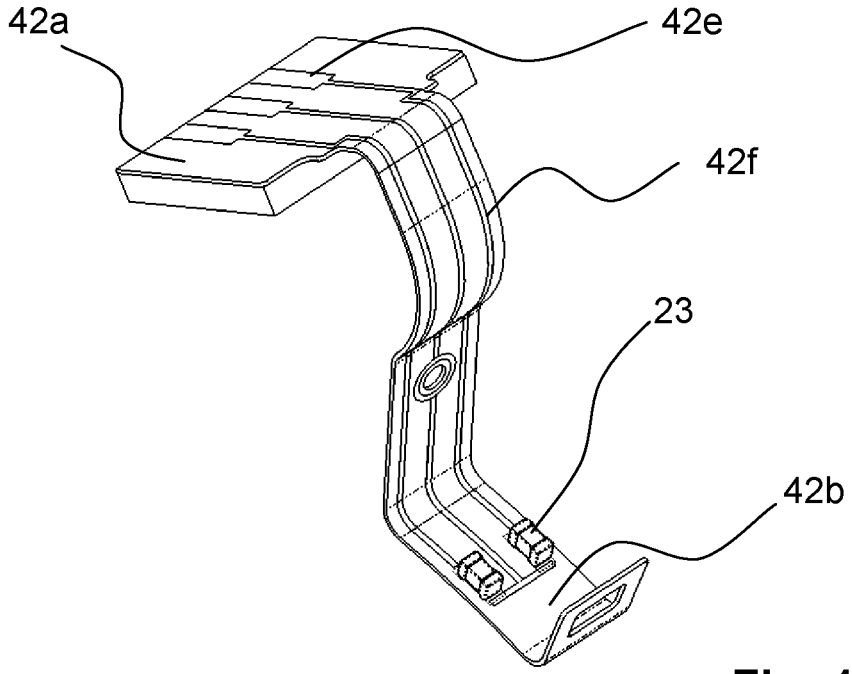
Figure 13C:
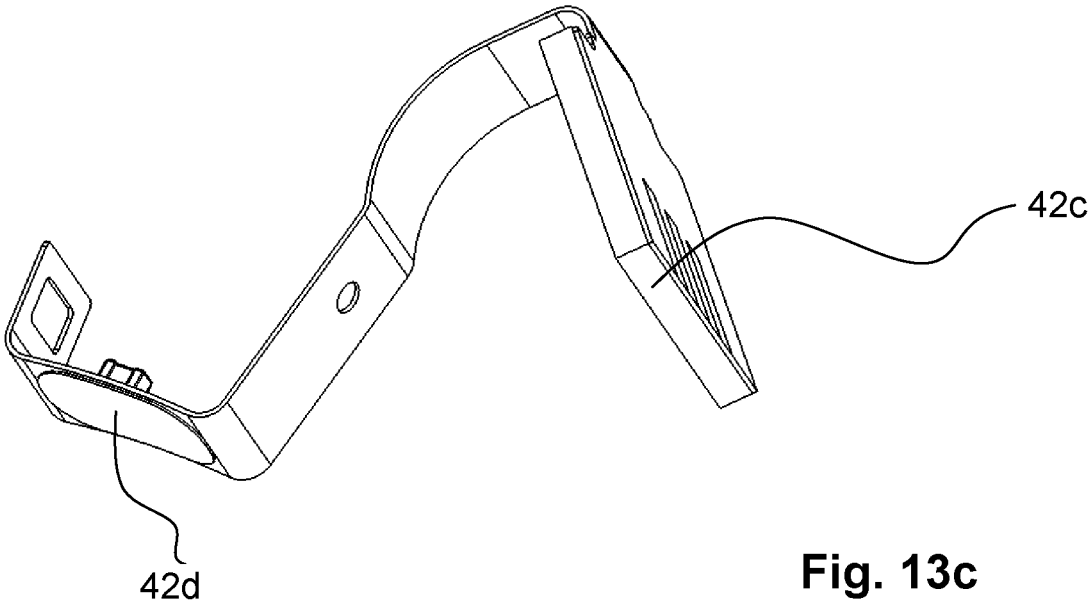
Figure 14A:
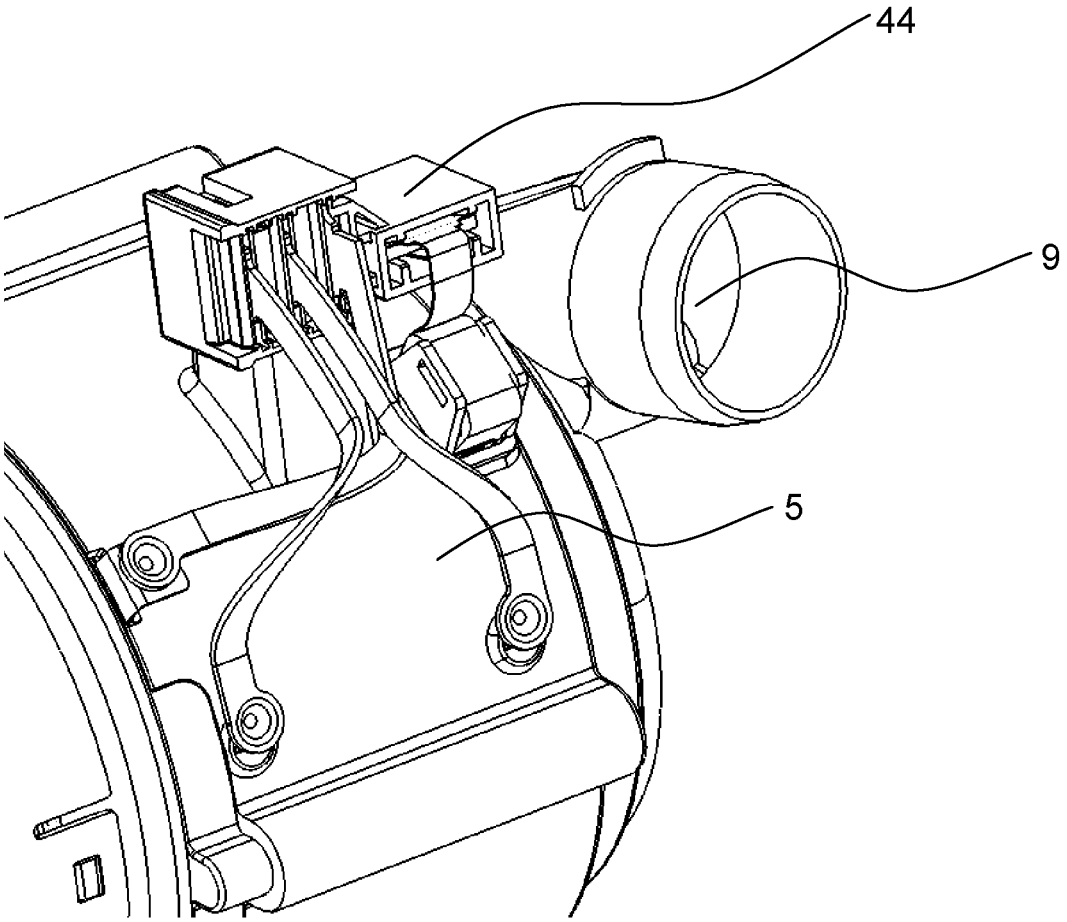
FIGS. 14*a* to 14*c* show the variant of the NTC element according to FIG. 13*a*, in particular the plug housing.

FIG. 13*a* shows a further variant of an NTC used as temperature sensor and/or safety device according to an embodiment of the present invention. In this variant, the NTC connector 42 has an S-shape with two end portions 42*a* and 42*b* which are tilted in opposite directions from the vertical connection portion. The NTC connector 42 is preferably made of non-flammable material, for instance a polyamide based compound. On one side, the NTC connector 42 is covered with an electrically insulating, but heat conducting layer (not shown), e.g. a thin film made of polyimide, preferably a Kapton film. As shown in detail in FIG. 13*b* one or more NTC elements 23 are provided on top of that film layer at the end portion 42*a*. They may be glued to the Kapton film using a heat conducting substance. NTC contacts 42*e* are provided on top of the thin layer on the other end portion 42*b*, e.g., via screen printing. They are connected with the NTC elements via contact lines 42*f*, which may also be provided via screen printing. As shown in FIG. 13*c*, the NTC connector 42 may be supported at the end portion 42*b* by a stiffener 42*c* (which is, e.g., glued, clamped, etc.) to be insertable in a plug-housing 44 as shown in FIG. 14*a*. At the surface of the NTC connector of the end portion 42*a* at the opposite side of the NTC elements 23, a heat conductive adhesive 42*d* may be provided. The end portion 42*a* which comprises the NTC elements 23 is pressed to the heating-element via an (elastic) spring-element 41. The elasticity or "spring-" functionality can be realized exploiting the geometry and/or the material of the spring-element 41. When the film-layer (with the NTCs) is pressed to the surface of the heating-element, the elastic-part will be deformed and at the end fixed by for instance a click-mechanism or screwed, etc. Alternatively also a conventional spring-element can be used for pressing the film-layer to the surface.

Figure 14B:
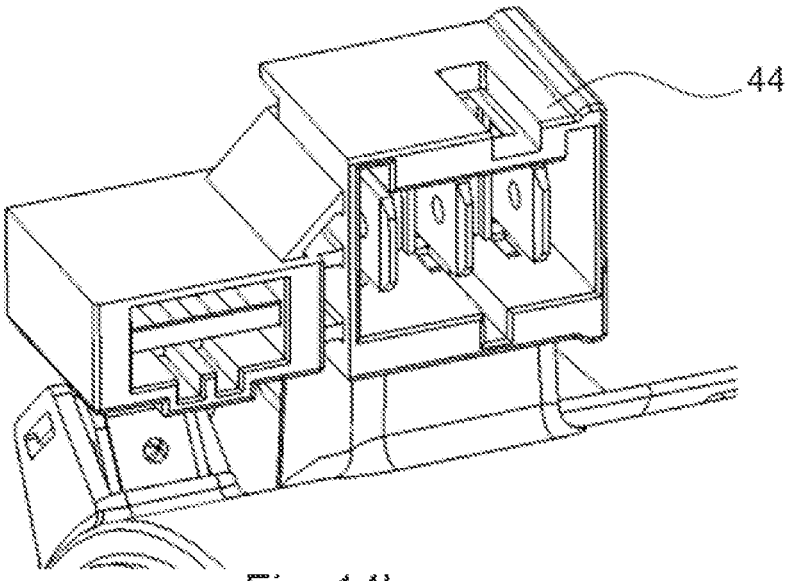
Figure 14C:
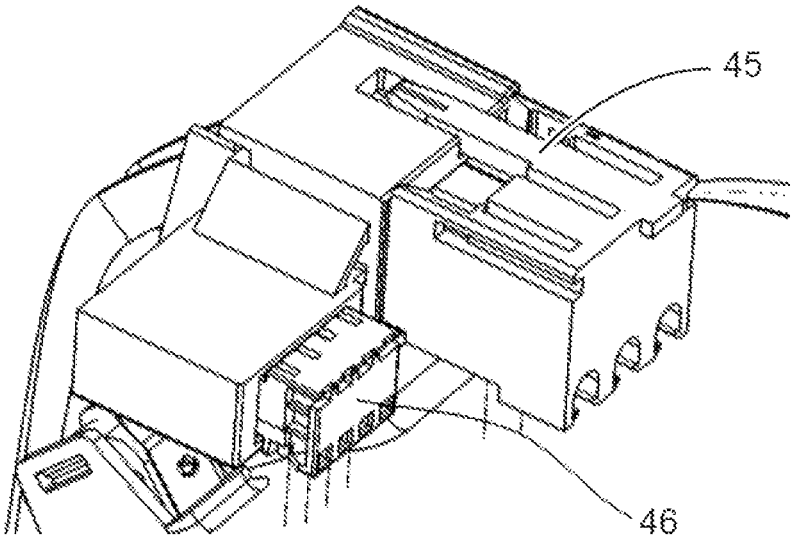

FIGS. 14*b* and 14*c* show a plug-housing 44 for power and NTC connection (3 pins for NTC and 2 pins for power—optionally 3, if grounding is required). Exemplary plugs which can be inserted in the plug housing 44 are RAST 5 IDC-Connector 45 and RAST 2,5 IDC-connector 46 as shown in FIG. 14*c*.

Figure 15:
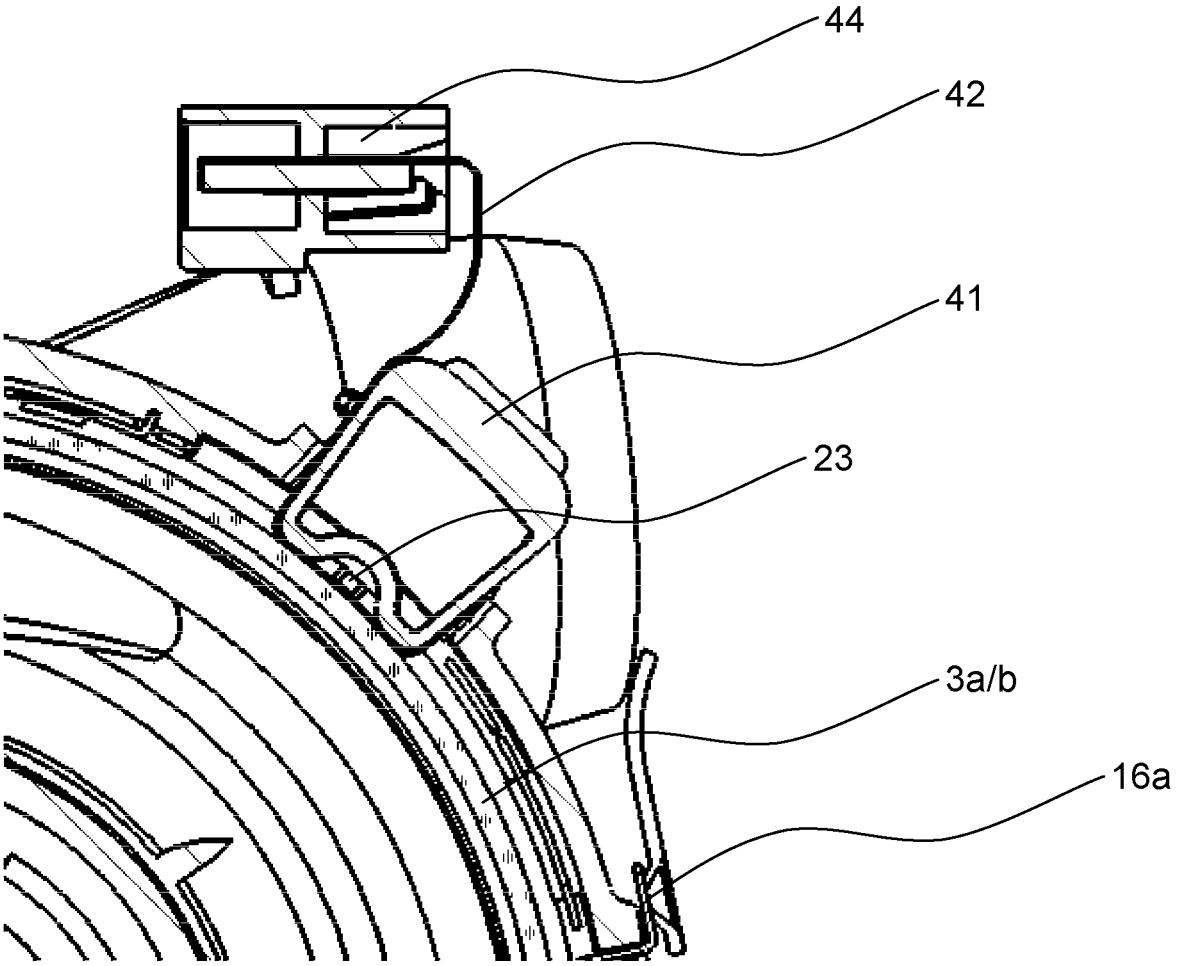
FIG. 15 shows a side view of the variant of an NTC element shown in FIG. 14*a*.

FIG. 15 shows a side view of the NTC connector variant shown in FIGS. 13*a* to 13*c* and FIGS. 14*a* to 14*c*.

While the invention has been illustrated and described in detail in the drawings and foregoing description, such illustration and description are to be considered illustrative or exemplary and not restrictive, and the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

REFERENCE SIGNS

1 motor unit
2 impeller
2*a* vanes
2*b* splitters
2*c* cover portion
2*d* vanes
3 heating element
3*a*, 3*b* electrical contacts
3*c* contact layer
3*d* cold area of heating element
4 heating reflector
5 fluid pump casing
5*a* top part
5*b* bottom portion
5*c* support
8*a*, 8*b* metal bands
8*c* contact points
9 outlet
10 fluid guide elements
11 inlet
12 suitable seals
13 can
13*a* metal contact
14 spring contacts
14*a* connectors
15 connectors
15*a* contact lines
16 contact sheets
16*a* Contact point (e.g., welded)
17 plug insert/plug link/plug bridge
18*a* radiation sensor
18*b* contact sensor
19 electrically insulating material
21 contact lines/conducting lines
21*a*, 21*b*, 21*c* contact lines
21*d*, 21*e*, 21*f* contact points
22 plug connection
22*a* contact pins
23 NTC elements
23*a* contacts
23*b* film layer
24 cover element
25 resilient member
26 contact casing
26*a* contact point
27 control element
28 fuse element
31 electrically insulating substrate
32 film layer
40 metal cylinder
41 spring element (for pressing the NTC on the surface of the heating element)
42 NTC-connector
42*a*, 42*b* end portions of NTC connector covered with Kapton film
42*c* stiffener for plug
42*d* heat-conducting adhesive
42*e* NTC contacts
42*f* contact lines
43 grounding (optionally—direct to medium)
44 plug-housing for power and NTC (3 pins for NTC and 2 pins for power—optionally 3, if grounding is required)
45 RAST 5 IDC-Connector
46 RAST 2,5 IDC-Connector
100 pump system
101 heated fluid pump unit
121 inner cylinder
122 inner chamber
123 outer chamber
124 opening
110, 120,130 140,150 fluid pump
180, 230 control/safety unit

The invention claimed is:

1. A fluid pump comprising:
a fluid pump casing having a cylindrical body portion;
a pump chamber inside the fluid pump casing and defined by an outer wall, a bottom part, a top part, an inlet, and an outlet;
a heat reflector made of metal and located on an inner wall of the cylindrical body portion of the fluid pump casing, the heat reflector protecting the fluid pump casing;
a heating element comprising:
a substrate made of an insulative material and comprising a first axial end and a second axial end, wherein the substrate has a cylindrical shape and forms the outer wall of the pump chamber;
a thin layer of monocrystalline, polycrystalline, or amorphous material on the substrate; and
electrical contacts being in contact with the thin layer,
wherein the thin layer has a thickness equal to or smaller than 10 μm, and
wherein at least the first axial end or the second axial end of the substrate comprises a region that remains uncovered by the thin layer and configured for coupling to another device,
wherein the thin layer faces, in a radial direction, the heat reflector,
wherein the heating element forms at least a portion of the outer wall of the pump chamber, and
wherein the fluid pump further comprises at least one control and safety unit on a contact layer, and the contact layer is on the region that remains uncovered by the thin layer.

2. The fluid pump according to claim 1, wherein at least one of:
the heating element is formed as a cylinder, wherein the first and second axial ends are at least partially open; and
the heating element is adapted to surround the pump chamber of the fluid pump.

3. The fluid pump according to claim 1, comprising an impeller rotatably mounted about its axis within the pump chamber, the impeller having a central hub with a plurality of vanes extending from the central hub, rotation of the impeller causing transference of a fluid admitted into the pump chamber via the inlet through the pump chamber along the outer wall of the pump chamber towards the outlet.

4. The fluid pump according to claim 1, wherein the heating element is surrounded by the fluid pump casing.

5. The fluid pump according to claim 3, wherein the impeller comprises a lid with vanes positioned on a side of the lid that is facing away from the impeller, wherein the lid rotates together with the impeller and the vanes of the lid are positioned in the same direction as the vanes of the impeller.

6. The fluid pump according to claim 1, further comprising fluid guide elements spirally or helically positioned inside the pump chamber to guide a fluid towards the outlet.

7. The fluid pump according to claim 6, wherein the fluid guide elements are positioned on an outer wall of the inlet or positioned at an inner side of the outer wall of the pump chamber.

8. The fluid pump according to claim 6, further comprising an inner cylinder positioned between the inlet and the fluid pump casing, wherein the pump chamber has an inner chamber and an outer chamber, wherein the inlet is positioned at an end of the pump chamber opposing an impeller and the outlet is positioned at the other side of the pump chamber, wherein the inner cylinder separates the inner chamber from the outer chamber and comprises an opening fluidly connecting the inner chamber and the outer chamber at the end of the pump chamber opposing the impeller, wherein the fluid guide elements are at least provided at a wall formed by the inner cylinder.

9. The fluid pump according to claim 1 further comprising one or more metal bands in direct contact with the electrical contacts provided on a top of the thin layer, wherein the one or more metal bands protrude from the fluid pump casing at one point to provide an electrical connection to an electrical power source.

10. The fluid pump of claim 1, wherein the substrate is glass, quartz glass, or ceramic.

11. The fluid pump of claim 1, wherein the electrical contacts are made of conductive ink or an electrically-conductive paste.

12. The fluid pump of claim 1, wherein the fluid pump casing is made of plastic, and wherein the heating reflector is a metal tube.

13. The fluid pump of claim 12, wherein a surface of the heating reflector facing the heating element has a smooth finish.

14. The fluid pump of claim 13, wherein the heating reflector is grounded.

* * * * *